US009015951B2

(12) United States Patent
Howell et al.

(10) Patent No.: US 9,015,951 B2
(45) Date of Patent: Apr. 28, 2015

(54) RAZOR CARTRIDGE WITH SKIN CONTACT ELEMENT

(75) Inventors: Daren Mark Howell, Winchester (GB); Andrew Martin Whittingham, Reading (GB)

(73) Assignee: The Gillette Company, Boston, MA (US)

( * ) Notice: Subject to any disclaimer, the term of this patent is extended or adjusted under 35 U.S.C. 154(b) by 358 days.

(21) Appl. No.: 13/524,717

(22) Filed: Jun. 15, 2012

(65) Prior Publication Data

US 2012/0324737 A1 Dec. 27, 2012

(30) Foreign Application Priority Data

Jun. 21, 2011 (EP) ..... 11170653

(51) Int. Cl.
*B26B 21/22* (2006.01)
*B26B 21/40* (2006.01)

(52) U.S. Cl.
CPC ..... *B26B 21/4018* (2013.01); *B26B 21/4031* (2013.01)

(58) Field of Classification Search
USPC ..... 30/34.05, 34.2, 50, 77
See application file for complete search history.

(56) References Cited

U.S. PATENT DOCUMENTS 5,369,885 A 12/1994 Ferraro
5,802,721 A 9/1998 Wain et al.
6,212,777 B1 * 4/2001 Gilder et al. ..... 30/50
6,243,951 B1 6/2001 Oldroyd
6,655,030 B2 * 12/2003 Zuidervaart ..... 30/50
7,448,135 B2 * 11/2008 Zhuk et al. ..... 30/50
7,617,607 B2 11/2009 Pennell et al.
7,681,314 B2 * 3/2010 Follo ..... 30/34.2
8,209,867 B2 7/2012 Clarke
8,413,334 B2 * 4/2013 Walker et al. ..... 30/50
8,429,826 B2 * 4/2013 Clarke ..... 30/34.2
8,448,339 B2 * 5/2013 Walker et al. ..... 30/50

(Continued)

FOREIGN PATENT DOCUMENTS

WO WO 94/11163 A1 5/1994
WO WO 95/29043 A1 11/1995

(Continued)

OTHER PUBLICATIONS

U.S. Appl. No. 13/524,650, filed Jun. 15, 2012, Oliver David Oglesby, Mark Peterson.

*Primary Examiner* — Hwei C Payer
(74) *Attorney, Agent, or Firm* — Joanne N. Pappas; Kevin C. Johnson; Steven W. Miller

(57) ABSTRACT

A razor cartridge has a housing, a guard located at a front of the housing and a cap located at a rear of the housing. A skin contact element is disposed in the housing partway between the guard and the cap. A skin contact plane defines a plane tangential to the guard and the skin contact element and a plane tangential to the skin contact element and the cap. One or more blades are located between the guard and the skin contact element, each of the blades having a cutting edge located at a distance $y_1$ between 70 μm and 300 μm and at an angle $\alpha_1$ between 20° and 45° below the skin contact plane. One or more blades are located between the skin contact element and the cap, each of the blades having a cutting edge located at an angle $\alpha_2$ above or below the skin contact plane, wherein $\alpha_2$ is lower in magnitude than $\alpha_1$.

11 Claims, 22 Drawing Sheets

(56) References Cited

U.S. PATENT DOCUMENTS

| | | | | |
|---|---|---|---|---|
| 8,782,903 | B2 * | 7/2014 | Clarke et al. | 30/34.1 |
| 2002/0035786 | A1 * | 3/2002 | Gilder et al. | 30/50 |
| 2004/0231161 | A1 | 11/2004 | Coffin et al. | |
| 2005/0198837 | A1 | 9/2005 | Rawle | |
| 2010/0083510 | A1 * | 4/2010 | Clarke | 30/346.5 |
| 2011/0146079 | A1 | 6/2011 | Clarke et al. | |
| 2011/0162209 | A1 * | 7/2011 | Wain | 30/50 |
| 2012/0110857 | A1 | 5/2012 | Peterson et al. | |
| 2012/0317818 | A1 * | 12/2012 | Oglesby et al. | 30/77 |
| 2012/0324737 | A1 * | 12/2012 | Howell et al. | 30/50 |
| 2014/0026424 | A1 * | 1/2014 | Oglesby et al. | 30/50 |

FOREIGN PATENT DOCUMENTS

| | | | |
|---|---|---|---|
| WO | WO 2011/075505 | A1 | 6/2011 |
| WO | WO 2012/061343 | A1 | 5/2012 |

* cited by examiner

RAZOR CARTRIDGE WITH SKIN CONTACT ELEMENT

FIELD OF THE INVENTION

This invention relates to razor cartridges, and more particularly to a razor cartridge having at least one skin contact element.

BACKGROUND OF THE INVENTION

Many razors for wet shaving on the market today have one or more razor blades (with many having three to six razor blades) within a razor cartridge which is operatively coupled to a handle, some razors being disposable and some razors having a reusable handle. Razor cartridges having multiple blades are described, for instance, in US Patent Publication No. 2005/0039337A1 published on Feb. 24, 2005, now U.S. Pat. No. 7,617,607, and one such razor cartridge has been commercialized as the five bladed Fusion™ Razor by The Gillette Company.

While multiple blades provide an improved close shave, generally some performance issues may still arise. Firstly, some discomfort may be realized by users during shaving. Secondly, shaving is still a relatively slow and inefficient process due to missed hairs and the difficulty in shaving problem areas such as the neck. Many shavers discern a substantial amount of missed hairs (e.g., hairs which are not cut at all or hairs that are not cut close to the skin or at the skin line) despite the bulk of hairs being cut.

In addition, it has been shown that some areas (e.g., neck, chin, and/or face) are particularly hard to shave. These areas generally have low-lying hairs that are often oriented in different directions. These low-lying hairs may be close, flat, or flush against the skin. In many instances, the user has to adopt different shaving techniques during a single shave in order to cut the various different types of hair.

As illustrated in FIG. 1A, a blade 2 will cut hair most cleanly when the blade edge 4 penetrates a hair at an angle substantially perpendicular to its direction of growth. In typical cartridges, where blades 2 are positioned at an angle of about 21° to a plane tangential to skin contact points at the front and rear of a cartridge (typically the guard and cap), this is achieved when a person shaves with the grain (i.e. in the direction of growth). Shaving with the grain is generally considered to be more comfortable than shaving against the grain (i.e. against the direction of growth). However, there is a chance when shaving with the grain that some hairs will be missed, particularly those that are low-lying or growing in a sub-optimal direction. Accordingly, some users choose to additionally shave against the grain as illustrated in FIG. 1B. Shaving against the grain enables low lying hairs to be scooped up by the blades and repositioned for effective cutting. However, when a person shaves against the grain with a cartridge as described above, the hair is pushed back and rotated against its direction of growth until it is positioned at an angle where the blade edge can penetrate the hair—for example, when the blade is substantially perpendicular to the hair. As the hair is rotated, it causes skin 6 behind the hair to bulge. Thus, once the blade edge has cut the hair, there is a chance that the blade edge will go on to penetrate the skin bulge behind the hair, causing pain and irritation.

One prior art reference, entitled Inter-Blade Guard and Method of manufacturing Same, Ser. No. 11/150,744 filed on Jun. 10, 2005, now U.S. Pat. No. 7,681,314, attempts to improve comfort by reducing skin bulge in front of a blade by providing inter-blade guard elements disposed on each individual blade. However, the benefit derived from these inter-blade elements applies when shaving with the grain only. Accordingly, no consideration is given to the different shaving habits a user may employ during a single shave.

Thus, there is still a need to improve skin and hair management (e.g., comfort and efficiency) in razor cartridges while maintaining or improving shaving attributes such as closeness.

SUMMARY OF THE INVENTION

The invention provides a razor cartridge comprising a housing, a guard located at a front of the housing, a cap located at the rear of the housing, a skin contact element disposed in the housing partway between the guard and the cap, a skin contact plane defined by a plane tangential to the guard and the skin contact element and a plane tangential to the skin contact element and the cap, one or more blades located between the guard and the skin contact element, each of said blades having a cutting edge located a distance $y_1$ between 100 μm and 300 μm and an angle $\alpha_1$ between 20° and 45° below the skin contact plane, one or more blades located between the skin contact element and the cap, each of said one or more blades having a cutting edge located at an angle $\alpha_2$ above or below the skin contact plane, wherein $\alpha_2$ is lower in magnitude than $\alpha_1$.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

The invention is applicable to razor cartridges in general that are used in a wet shaving system.

Figure 2:
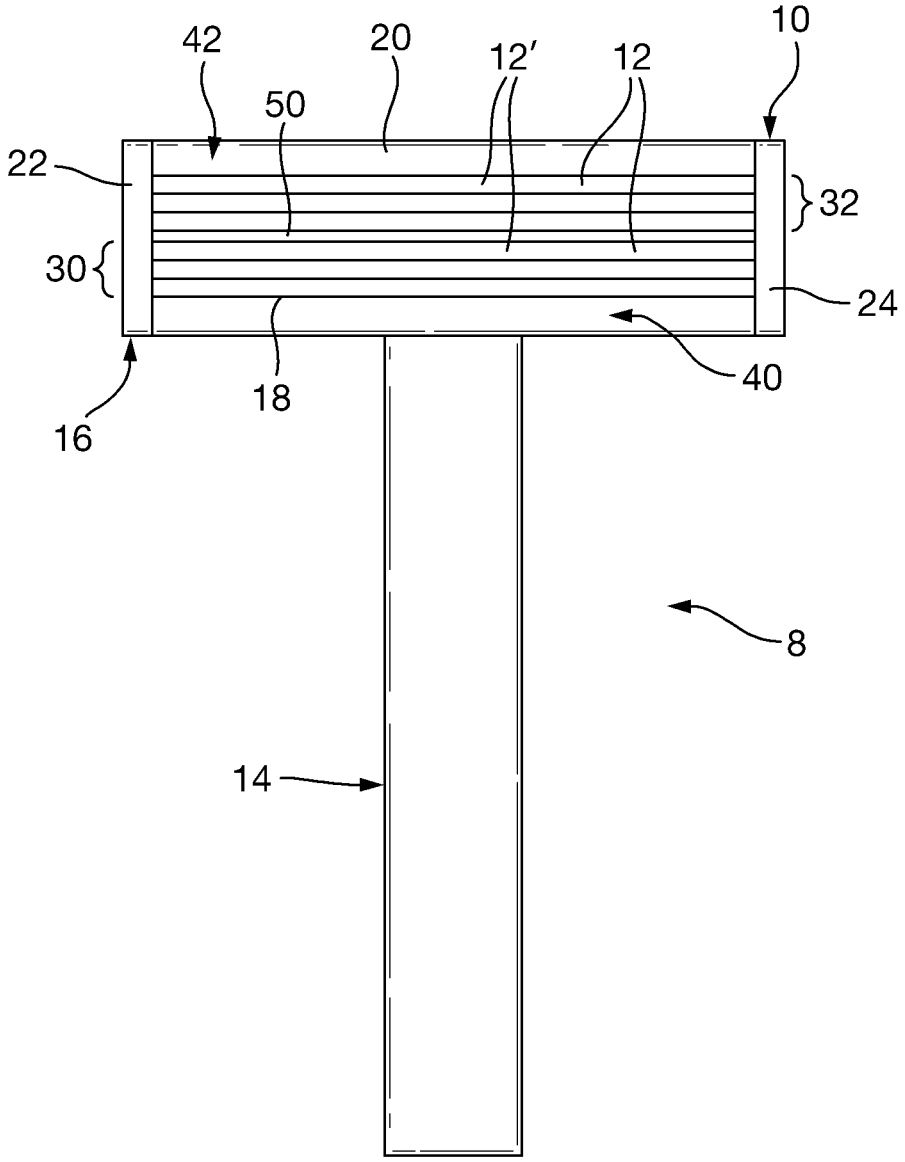
FIG. 2 shows a razor including a skin contact element of the present invention.

FIG. 2 shows a wet shaving razor 8 formed of a cartridge 10 attached to a handle 14. The razor cartridge 10 is formed of a housing 16 having a front 18, a rear 20 and first and second opposing side walls 22, 24 disposed transverse to and between the front and rear of the cartridge. A skin contact element 50 is located partway between the front and rear of the cartridge and extends between opposing side walls. The skin contact element 50 defines a first blade array 30 located between the front of the cartridge and the skin contact element and a second blade array 32 located between the skin contact element and the rear of the cartridge. At least one blade 12 having a cutting edge 12' is provided in each of the first and second blade arrays, with the cutting edges of each blade in the first or second blade array being directed towards the front of the cartridge.

A front skin contact area, typically a guard 40, is located at the front of the cartridge, and a rear skin contact area, typically a cap 42, is located at the rear of the cartridge. In general, the guard 40 is provided at the front of a cartridge to increase friction between the cartridge and skin that is being shaven. This increase in friction stretches the skin ahead of the blades, reducing skin bulge in front of the blades and accordingly, reducing the likelihood of irritation of the skin. In some embodiments, the guard is designed to support or align hairs during the shaving process. Likewise, the cap is generally known to be a lower friction element located at the rear of the cartridge, allowing skin to glide past the back of the cartridge while still providing support for the skin. In embodiments the cap provides lubrication, smooth glide or other skin control. It will be appreciated that in an alternative embodiment, the respective positioning of the guard and cap may be reversed. Furthermore, in an embodiment, either the guard or cap may be formed separately to the housing and mounted directly to the razor handle.

In razor cartridges currently available on the market, a skin contact plane across the cartridge is defined as the plane tangential to the guard and cap. Such cartridges typically have three or more blades, with the blade in primary position being that blade nearest the guard. Skin is most taut immediately adjacent the guard such that the load on the blades when shaving is lightest for the blade in primary position. By contrast, skin bulges into the cartridge such that the load is greatest on the blade nearest the cap. This means that the risk of a blade engaging skin instead of hair is greatest at the rear of a cartridge.

In the present invention, the skin contact plane ($P_S$) from the front to the rear of the cartridge is made up of a first array plane $P_{1A}$ across the first blade array 30 and a second array plane $P_{2A}$. The first array plane is tangential to the front skin contact area (typically the guard) of the cartridge and the skin contact element. The second array plane is tangential to the skin contact element and the rear skin contact area (typically the cap) of the cartridge.

In the present invention, the skin contact element substantially reduces the amount of skin bulge across the cartridge compared with cartridges currently on the market by reducing the distance between skin supporting structures within the cartridge. The skin contact element resets the skin contact plane midway through the cartridge, thereby creating the effect of two separate cartridges in one. The present inventors have adapted the geometries of the blades in each of the two blade arrays to optimize the effectiveness of the shave.

It is known that varying the angle of a blade significantly impacts the way in which hair is cut. For example, increasing the angle of a blade edge below the skin contact plane generally lowers the cutting force required when cutting hairs growing in the direction of a shaving stroke. However, such a higher angle blade is more likely to cause nicks and cuts in skin as the blade edge will contact skin at a more aggressive angle. Conversely, comfort of a shave can be increased by decreasing the angle between a blade edge and the skin contact plane, but this can have a negative impact on the closeness/efficiency of the shave. Resetting the skin contact plane, as described herein, allows for multiple blade arrays with different characteristics to be present in the same cartridge.

Figure 3A:
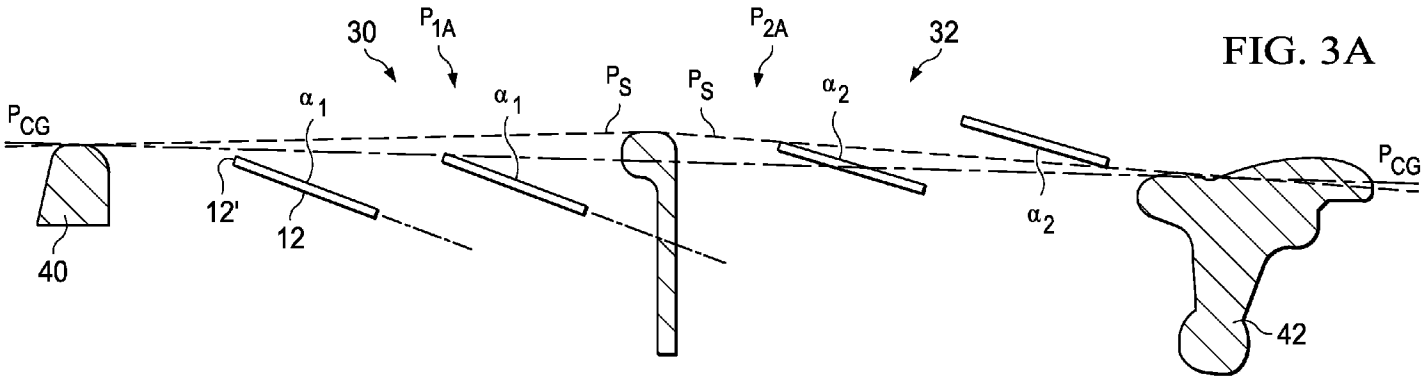
FIG. 3A shows a schematic cross-section of an embodiment of the present invention.

FIGS. 3A and B show an embodiment having two blades 12 in the first blade array 30 and two blades 12 in the second blade array. It will be appreciated that one or more than two blades could be located in either blade array. For example, there may be one, two, three or four blades located in the first blade array. Likewise, there may be one, two, three or four blades located in the second blade array.

As shown in FIGS. 3A and B, the blades located in the first blade array are positioned with their cutting edges directed towards the guard at an angle $\alpha$ of between 20°, 25° or 30° and 40° or 45° below the skin contact plane. Blades located in the second blade array are positioned with their cutting edges directed towards the skin contact element at an angle of between 15°, 10° or 5° below (−15°, −10° or −5°), in-line to, and 5°, 10° or 15° above (+5°, +10° or +15°) the skin contact plane. Thus, blades in the first blade array cut hairs with a lower cutting force, while blades in the second blade array cut hairs with greater comfort.

It is also known that the distance of a blade edge from the skin contact plane has an impact on the closeness of a shave. A blade edge located near to or in the skin contact plane will provide a closer shave than a blade located away from the skin contact plane. However, the proximity of a blade to the skin contact plane increases the risk of contact between the blade edge and skin. In the present invention, blades located in the first blade array have blade edges located a distance $d_1$ between 70 μm, 150 μm or 200 μm and 250 μm, 300 μm or 350 μm below the first array plane. In embodiments, at least the blade nearest the guard has a blade edge located 70 μm below the first array plane. Blades located in the second blade array have blade edges located a distance $d_2$ between 70 μm or 50 μm below (−70 μm or −50 μm) the second array plane, in the second array plane (0 μm) to (+) 100 μm, 200 μm, 300 μm, 400 μm and 500 μm above the second array plane. In embodiments, at least the blade nearest the skin contact element is in line with the second array plane. In embodiments having more than one blade in the first second blade array, the blade nearest the cap is located 200 μm above the skin contact plane.

With this arrangement of different angled blades in the first and second arrays, it is possible to address different shaving needs within the same cartridge. For example, when shaving with the grain, blades in the first blade array engage with individual hairs at an angle substantially perpendicular to the length of the hair. As the cutting edges of blades in the first blade array are positioned some distance from the skin contact plane (or the first array plane), they will likely cut hairs shorter, without cutting them down to skin level. By contrast, when shaving with the grain, blades in the second blade array either do not engage with hairs, or they "skive-cut" the hairs. A skive-cut occurs when the blade edge cuts into one side of a hair and, rather than cutting straight across the hair, cuts diagonally through the shaft, leaving one side of the hair longer than the other side. Thus it can be seen that when shaving with the grain, the different blade arrays interact with hair in different ways, resulting in a more comfortable shave than razors currently on the market but one that does not perhaps cut hairs as close to the skin.

When shaving against the grain, blades in the first blade array will only engage with hairs that are of a length extending beyond the distance $d_1$ of the cutting edge from the skin contact plane. Where cutting edges of blades in the first array do engage with hairs growing against the grain, the hairs may be pushed back and rotated in the direction of the shave resulting in skin immediately behind the hair bulging. As the cutting edges in the first array lie below the skin contact plane, there is less likelihood compared with razors currently on the market that the cutting edges will engage with the skin, thus reducing the chance of causing nicks and cuts. By contrast, the cutting edges of blades in the second blade array tend to engage hairs at an angle substantially perpendicular to the length of the hairs thus resulting in a clean cut of hairs growing against the grain. As such, the hairs are not pulled and this reduces the likelihood of there being skin bulges behind the hair. As the cutting edges lie either in or adjacent the skin contact plane, the hairs are cut at or close to skin level. This results in a close yet comfortable shave.

Thus, overall, when a user shaves both with and against the grain, they are able to achieve a shave that is at least comparable in terms of closeness to razor cartridges currently on the market, but with a significant increase in comfort levels.

In embodiments having more than one blade within the first or second blade array, the respective blades may be positioned with their cutting edges at different angles or distances to the skin contact plane. For example, where two or more blades are provided in the first blade array, the cutting edge of the blade adjacent the guard may have a greater angle relative to the skin contact plane compared with subsequent blades. In this respect, and as described above, skin bulges into a cartridge more as the distance between a blade and skin supporting element (for example, the guard) increases. The chance of penetration of skin by a cutting edge increases with blades that are positioned further away from the guard. Reducing the angle of latter blades reduces discomfort caused by a blade where the load on a blade is highest.

Figure 4:
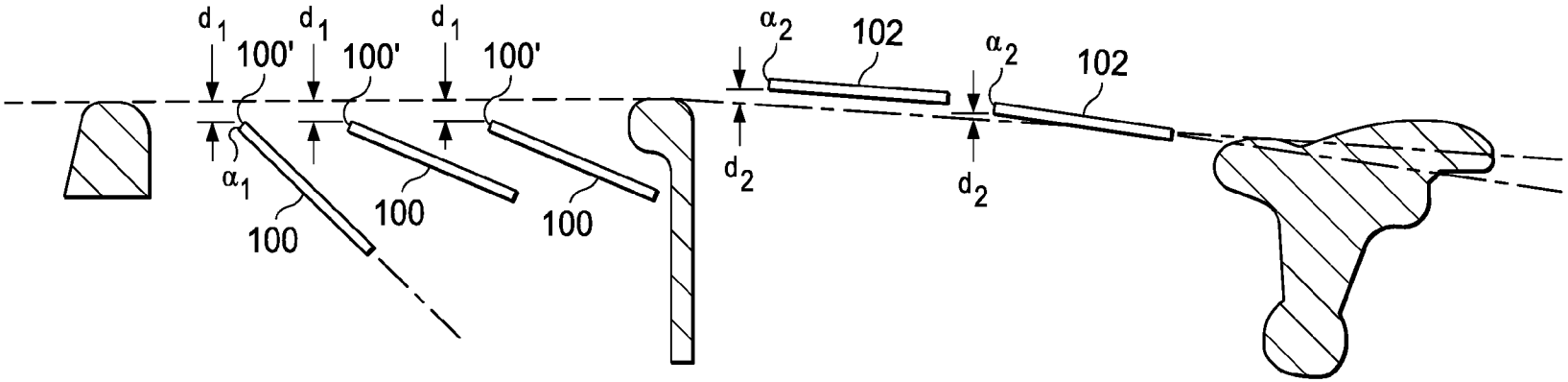
FIG. 4 shows schematically a cross-section of an alternative embodiment of the present invention.

FIG. 4 shows an embodiment of a cartridge having three blades 100 with blade edges 100' in the first blade array. The blade nearest the guard (the primary blade) is positioned with its blade edge at an angle of approximately 40° below the skin contact plane. By contrast, the blades in the secondary and tertiary positions are positioned at an angle of approximately 25° below the skin contact plane. The blade angle is decreased at the point in a cartridge where the load on the blade is at its highest, thus resulting in a more comfortable shave. It will be appreciated that, in an alternative embodiment (not shown), blades in the secondary and tertiary positions could have successively decreasing angles relative to the primary blade. In the embodiment shown in FIG. 4, the distance $d_1$ between the blade edges and the skin contact plane remains substantially the same for the primary, secondary and tertiary blades. It will be appreciated that in alternative embodiments, the distance $d_1$ between blade edges and the skin contact plane may progressively decrease from the primary blade to the tertiary blade as is the case in cartridges currently being sold in the Fusion® range. In cases where the distance $d_1$ progressively decreases, the increase in possible discomfort caused by proximity of the blade edge of the secondary and tertiary blades to skin is offset by the reduced angle, resulting in a closer yet more comfortable shave.

FIG. 4 also shows two blades 102 in the second blade array. As can be seen, the blade edge of the primary blade has an angle $\alpha_2$ of approximately 0, i.e. the blade lies in the skin contact plane. The secondary blade of the second blade array has an angle of approximately 5° below the skin contact plane. Furthermore, as shown in the embodiment of FIG. 4, the primary blade has a distance $d_2$ of approximately 100 μm above the skin contact plane whereas the secondary blade has a distance $d_2$ of approximately 250 μm above the skin contact plane. The latter blade is therefore able to cut hair at or below skin level while still maintaining increased comfort because of the reduced angle between the blade edge and the skin contact plane compared with razors currently on the market. Furthermore, by the time the blade adjacent the cap is required to shave in a single stroke, very few hairs are expected to remain on the skin. This reduction in hairs offsets the slight decrease in discomfort caused by having a relatively higher angle blade towards the rear of the cartridge.

Figure 3B:
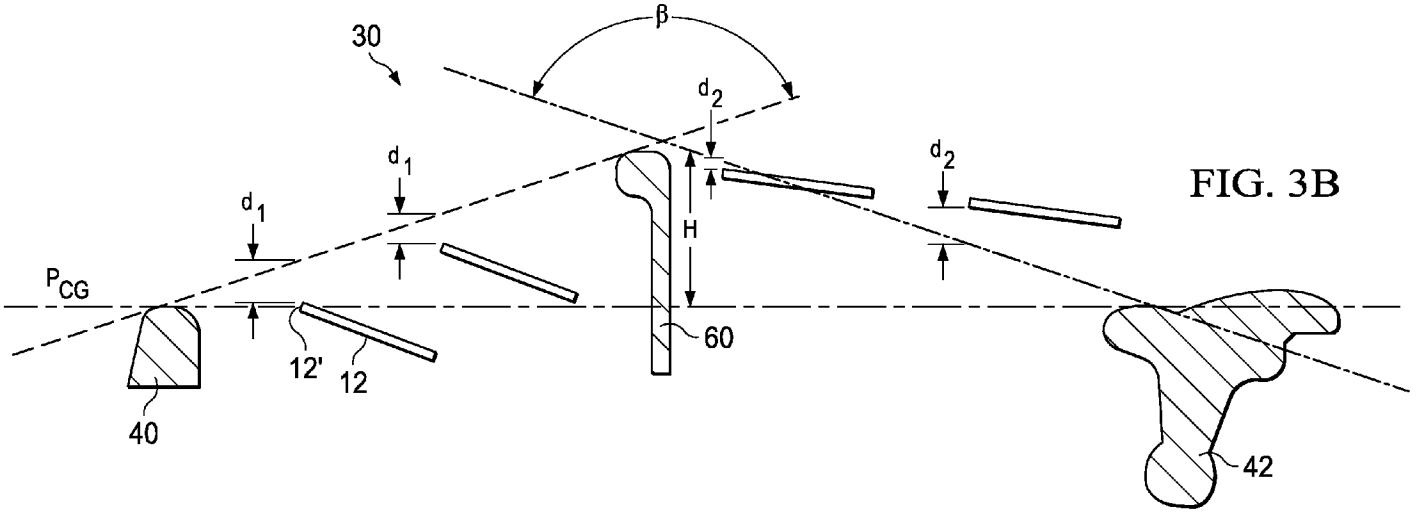
FIG. 3B shows a schematic cross-section of an alternate embodiment of the present invention.

As shown in FIG. 3B, the top surface 60 of the skin contact element has a height H of between 50 μm, 100 μm or 200 μm and 300 μm, 400 μm or 500 μm from the guard to cap plane $P_{CG}$. This resets the skin contact surface thus enabling the different arrangements of blades in each of the first and second blade array described herein. In embodiments, the skin contact element is positioned to result in an angle β of between 145°, 155° or 160° and 170°, 175° or 180° between the first array plane and the second array plane. It will of course be appreciated that the angle between the first array plane and the second array plane is determined by the height of the skin contact element relative to the guard to cap plane $P_{CG}$ and the respective widths between the guard to skin contact element and the skin contact element to cap. For example, the angle between the first array plane and second array plane is at a minimum when the height of the skin contact element is at a minimum and the distance between cap and guard is at a maximum. Conversely, the angle between the first array plane and the second array plane is at a maximum when the height of the skin contact element is at a maximum and the distance between cap and guard is at a minimum.

In embodiments, the skin contact element may take the place of one of the blades in a standard cartridge, as shown in FIGS. 3A and B. FIG. 3A shows the skin contact element positioned midway through the cartridge in or near the standard $3^{rd}$ blade position. In this case, the skin contact element takes the place of one of the blades to split the cartridge into two blade arrays. In alternative embodiments, the skin contact element may take the place of a blade in a different position, for example, in the second or fourth position. In a further alternative embodiment, the skin contact element may be positioned between existing blades, such that it does not replace any of the blades, as shown in FIG. 4.

As described herein, the skin contact element is a physical structure which generally does not cut hair or skin but contacts, engages, controls, enhances, agitates or stretches a user's skin and/or hair providing skin management (e.g., reduction of skin bulge) and/or hair management (e.g., alignment of hairs) during shaving and which may be of any type, size, shape or geometry including, but not limited to, having a portion or an upper surface with at least one feature selected from the group consisting of a plurality of projections defining at least one open slot, protrusions, elongated filaments, nubs, fins, waves, curves, depressions, hair-like elements, one or more hook-like structures, one or more lubricating strips, one or more foams, one or more exfoliation materials, one or more shaving aid materials, one or more comb-like features having a plurality of teeth, any of the aforementioned spaced apart or interconnected, constant or variable in dimensions, or any combinations thereof. The skin contact element of the present invention may have features that are, but not limited to, upstanding, curved, angled right, angled left, or angled to a center and which may be flexible, rigid, or semi-rigid, may have planar or non-planar surfaces, may be contiguous, non-contiguous, patterned, or be any combination thereof.

The skin contact element of the present invention may be made of any type of material such as, but not limited to, polymeric, elastomeric, thermoplastic elastomers, urethanes, olefins, rubbers, metals, or any combination thereof. Elastomers such as silicone, fluorosilicone, polyisoprene, polybutadiene, polyisobutylene, copolymers such as styrene-ethylene-butylene-styrene (SEBS) based thermoplastic elastomer, styrene-ethylene-propylene-styrene (SEPS) based thermoplastic elastomer, polyoxyethylene-polyurethane based elastomer, or other polymers such as polyurethane, polystyrene and polyethylene, or rubbers such as acrylonitrile-butadiene, polyacrylate and natural rubber, or any combination thereof are also contemplated in the present invention. Additionally, the skin contact element material may include modifications of one or more of the above-listed materials (e.g., polymers and rubbers and their composites) with other materials.

If made of a polymeric or other elastomeric material, the skin contact element may be injection-molded. If made of metal, such as aluminium or stainless steel, the skin contact element may be machined or tooled.

Furthermore, the materials for a skin contact element may include textile or fabric materials, natural materials (e.g., wood), or metals coated or integrated with elastomeric or plastic materials.

The skin contact element of the present invention may additionally include materials with exfoliation capabilities (e.g., such as fine grade abrasive coatings, chemicals, or surface texture) providing an exfoliation member and may additionally include materials with chemicals affecting the skin or hair (e.g., skin improvement, such as but not limited to, lubrication or sensation, hair management, such as but not limited to, growth minimization or extension, conditioning), or any combination thereof.

Furthermore, the skin contact element may include a lubrication body such as soap, a sponge or foam embedded or coated with shaving aid material or other chemistries, or an elastomeric guard-like structure embedded or coated with a layer of shaving aid material or other chemistries. The foam may be basic foam or sponge material or a gradient foam as disclosed in U.S. patent application Ser. No. 12/350,286, now U.S. Pat. No. 8,308,388, entitled Fluid Delivery System and in U.S. patent application Ser. No. 12/350,446, U.S. Patent Application Publication No. 2009/0178282 A1, entitled Hair Removal with Fluid Delivery assigned to the Assignee of the instant invention.

The term "shaving aid material" as used herein signifies any composition for use with skin and/or hair. Such compositions may include, but are not limited to, lubricious agents such as hydrophilic polymers (e.g., polyethylene oxide/polystyrene or PEO/PS), or agents for depilation, cleaning, cooling, inhibiting or enhancing the growth of hair, inhibiting the growth of microbes, inhibiting drag, inhibiting wrinkles, moisturizing, improving skin tone or condition, medicinal purposes, or any combination thereof. Agents may include, but are not limited to, ingredients such as aloe, vitamin E, lanolin, perfumes, or glycolic acids.

The chemistries disposed in the skin contact element may interact with the chemistries found in the cap or the guard of the razor cartridge. Additionally, the skin contact element of the present invention may serve as a wear-indicator.

Additionally, it should be noted that the skin contact element of the present invention may be utilized in any type of razor cartridge and thus naturally in both male and female type razors.

Figure 5A:
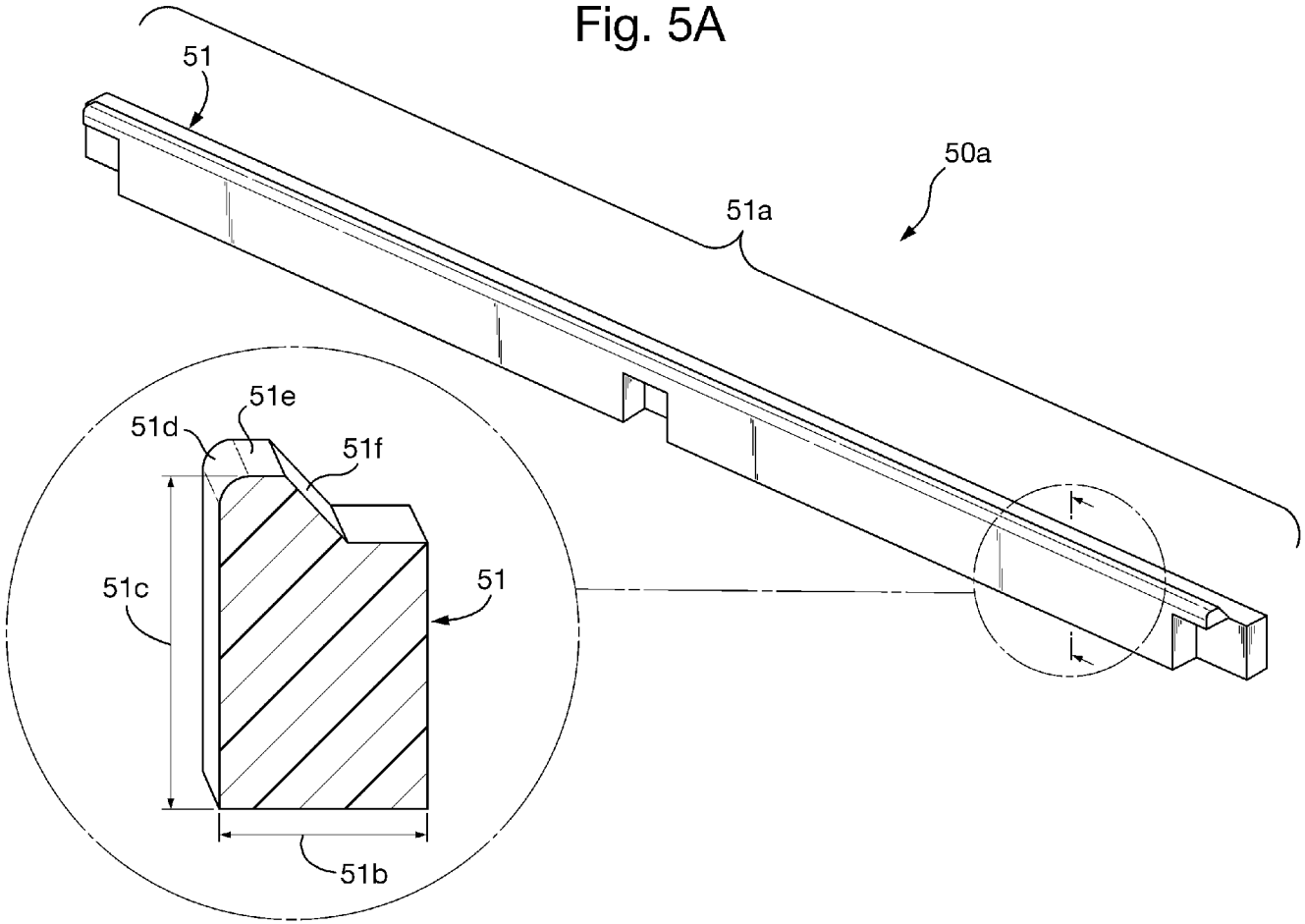
FIG. 5A to 5N are perspective views of possible embodiments of skin contact elements in accordance with the present invention.
Figure 5B:
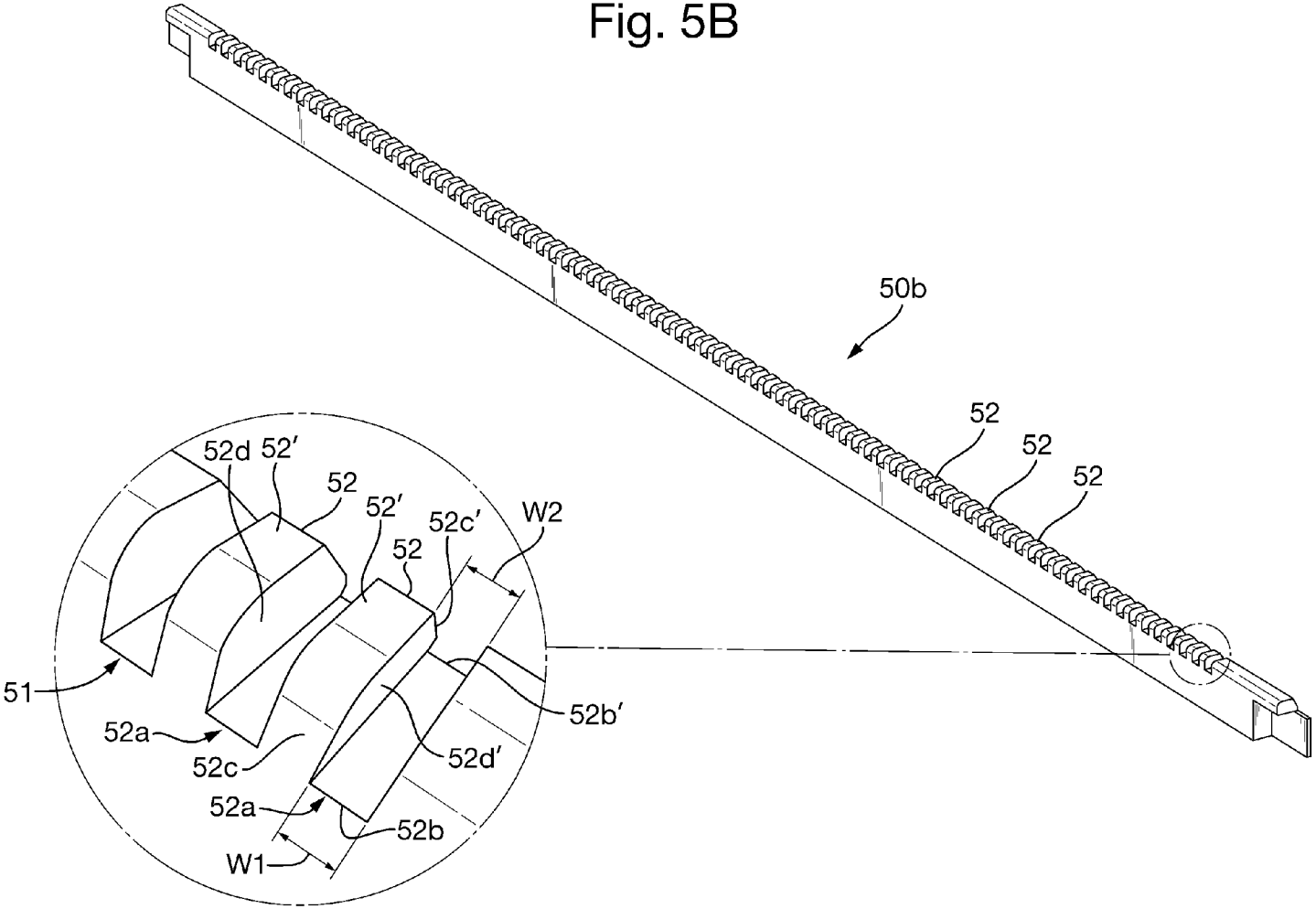
FIG. 5O is a top view of a plurality of teeth in a skin contact element in accordance with the present invention.
FIG. 5P is a perspective view of FIG. 5O.
FIG. 5Q is a top view of a possible embodiment of a skin contact element with teeth in accordance with the present invention.
FIG. 5R is a cross-sectional view of various skin contact elements in contact with skin in accordance with the present invention.
Figure 5C:
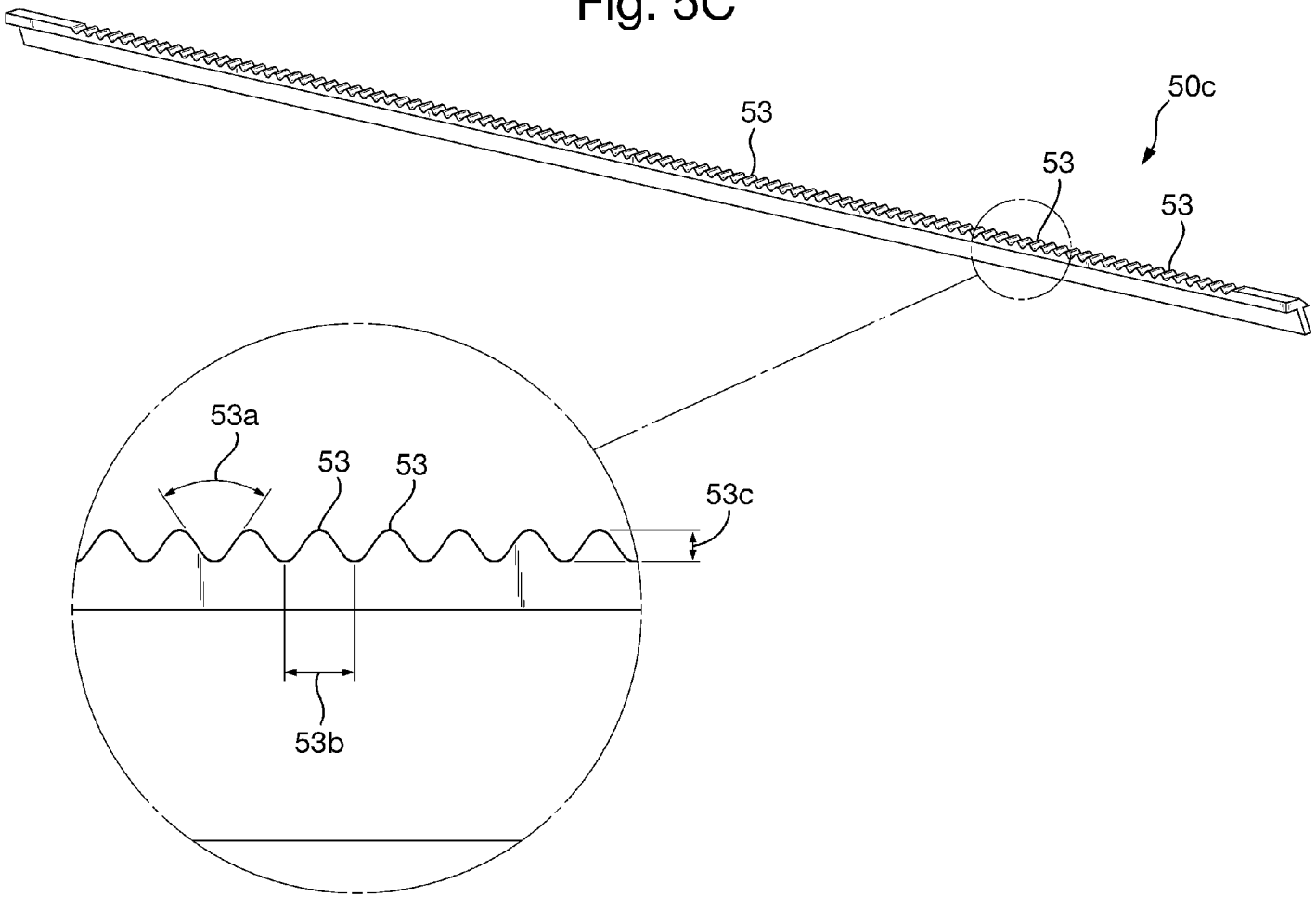
Figure 5D:
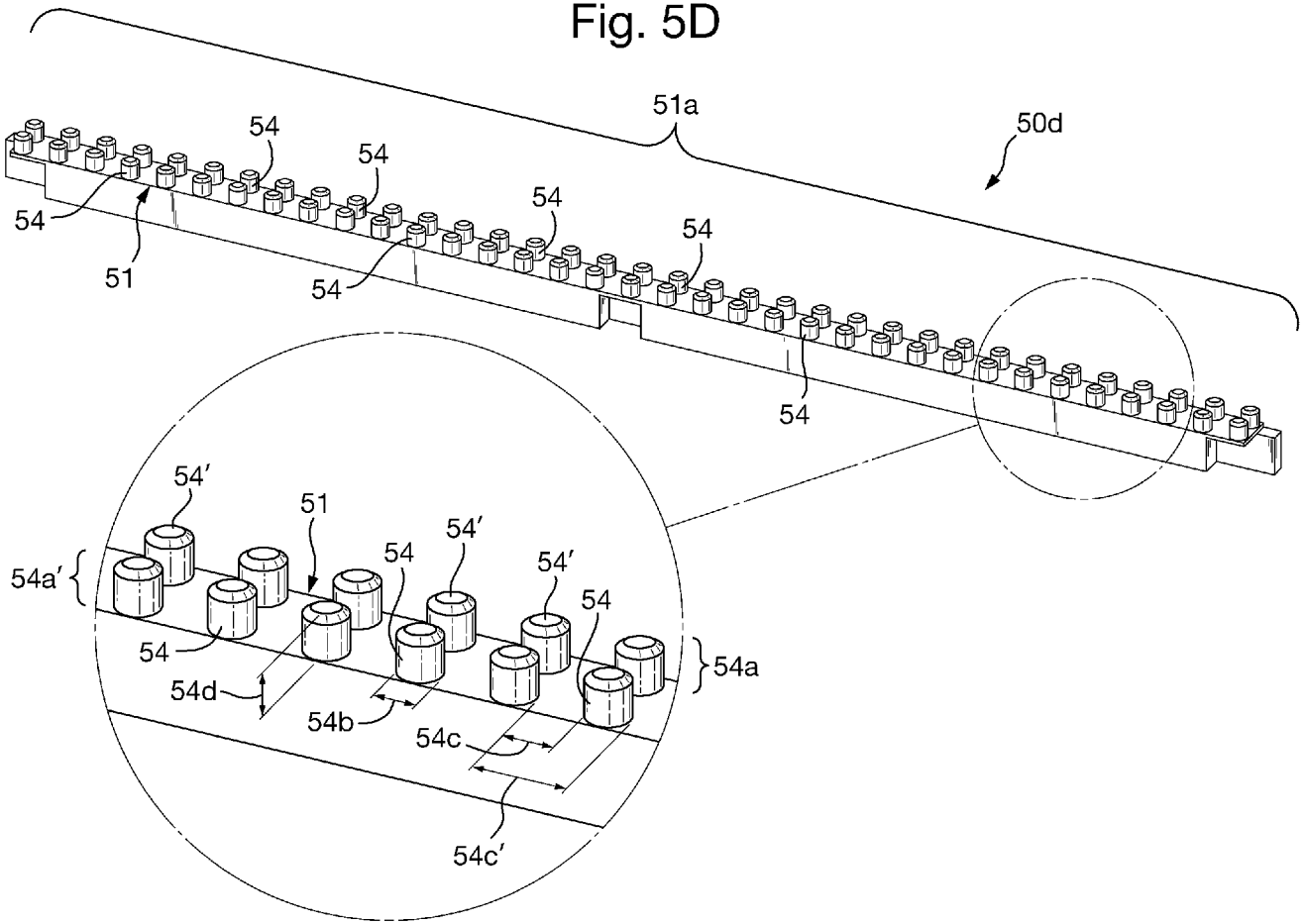
Figure 5E:
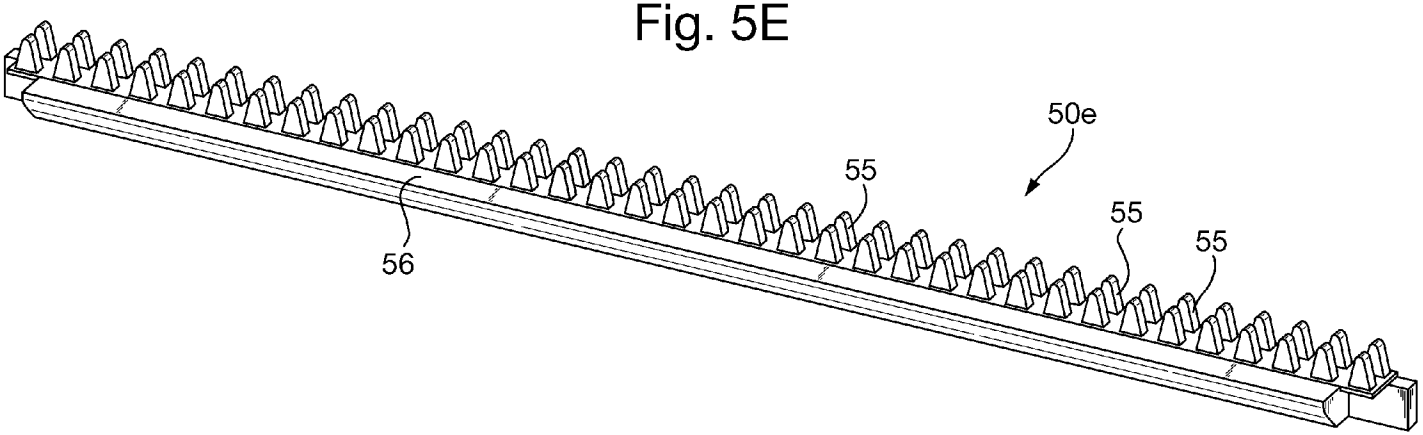
Figure 5F:
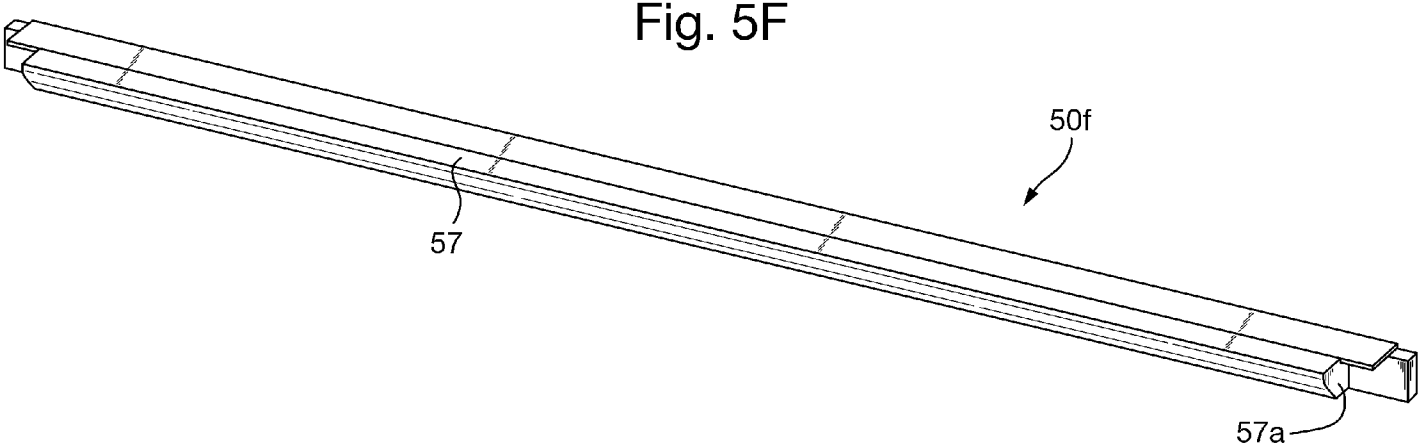
Figure 5G:
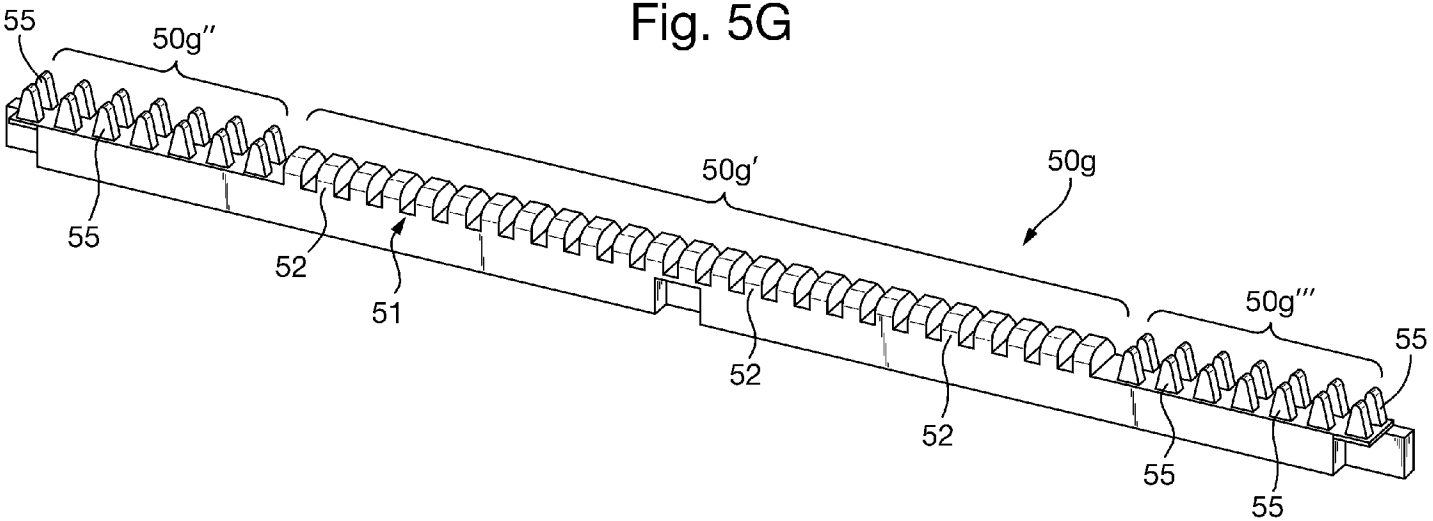
Figure 5H:
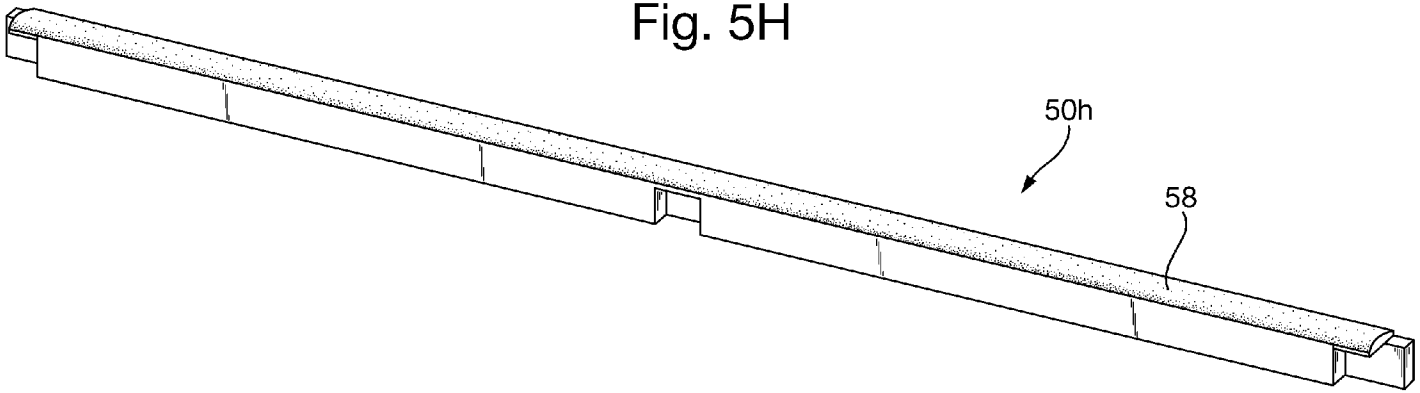
Figure 5I:
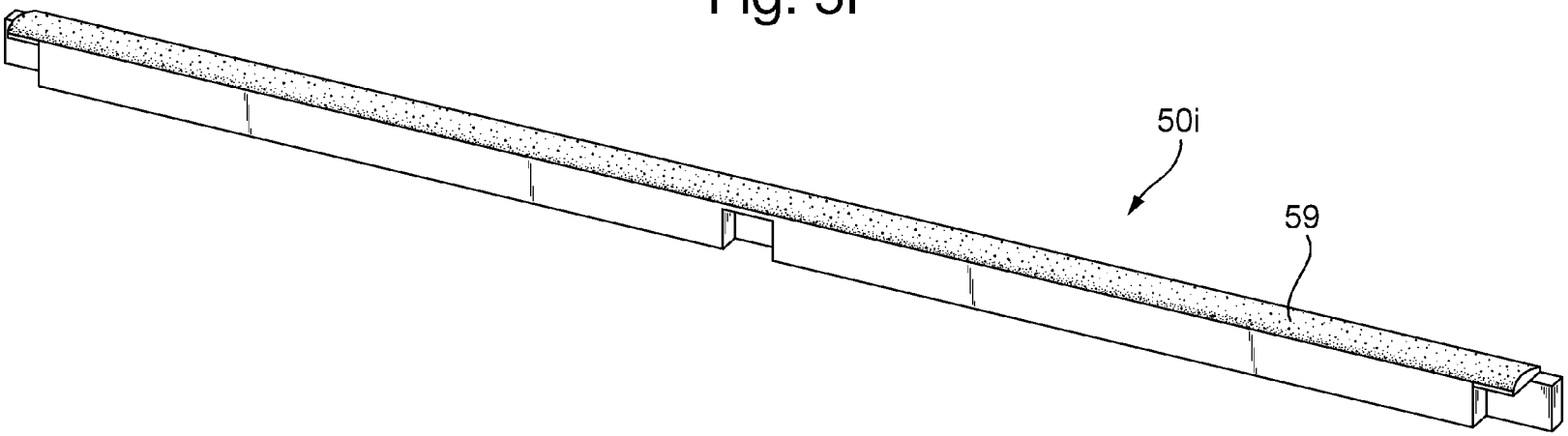
Figure 5J:
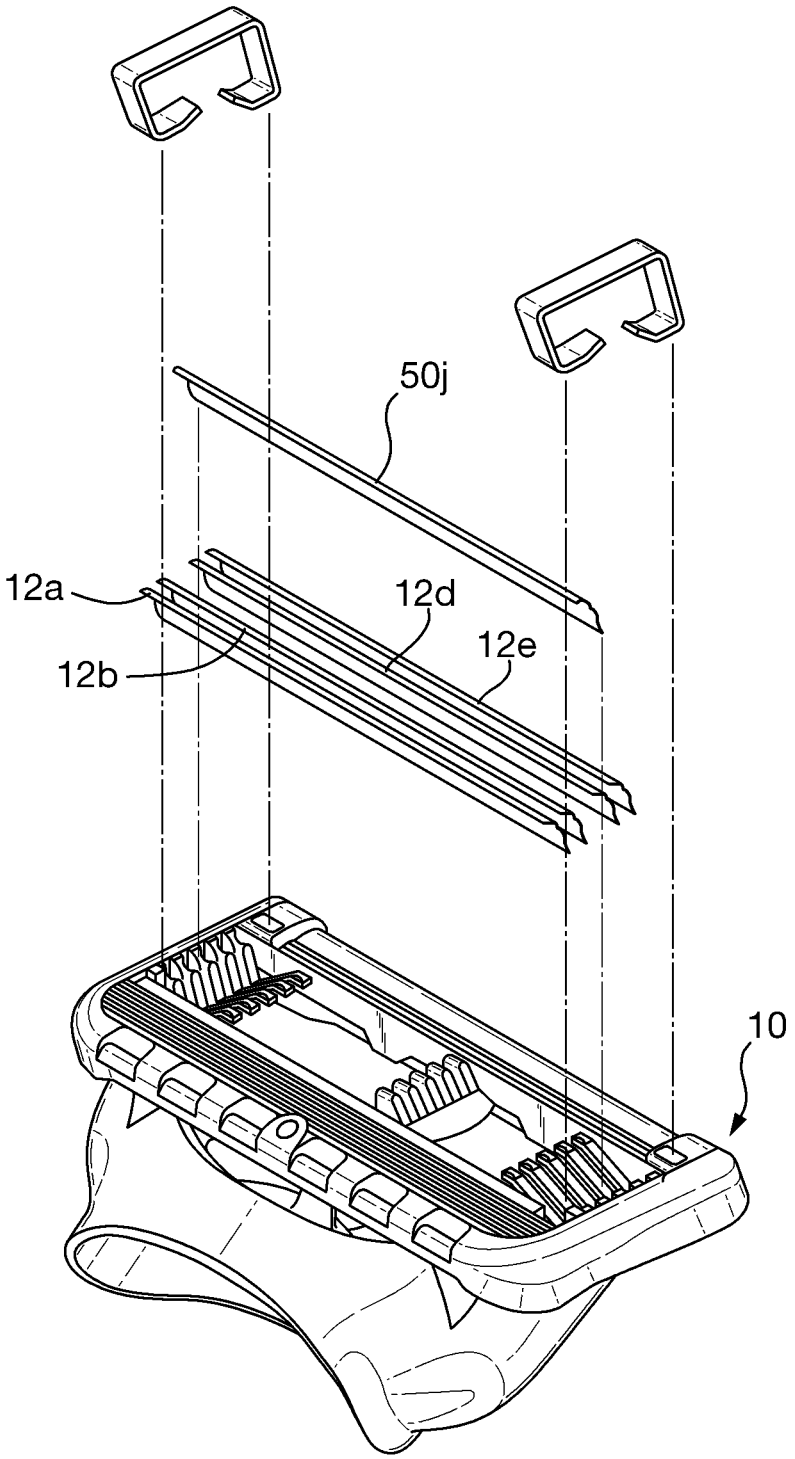
Figure 5K:
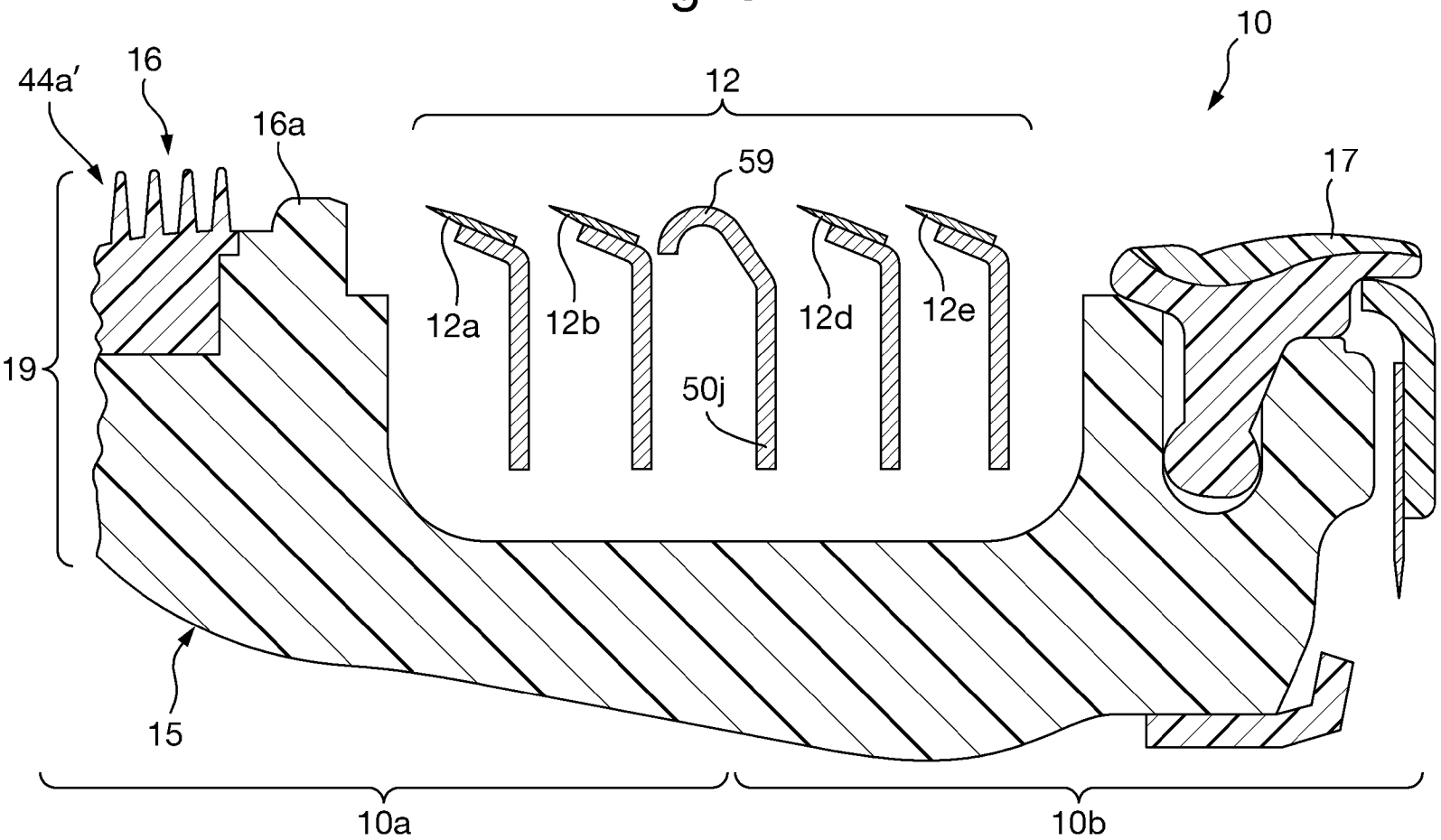
Figure 5L:
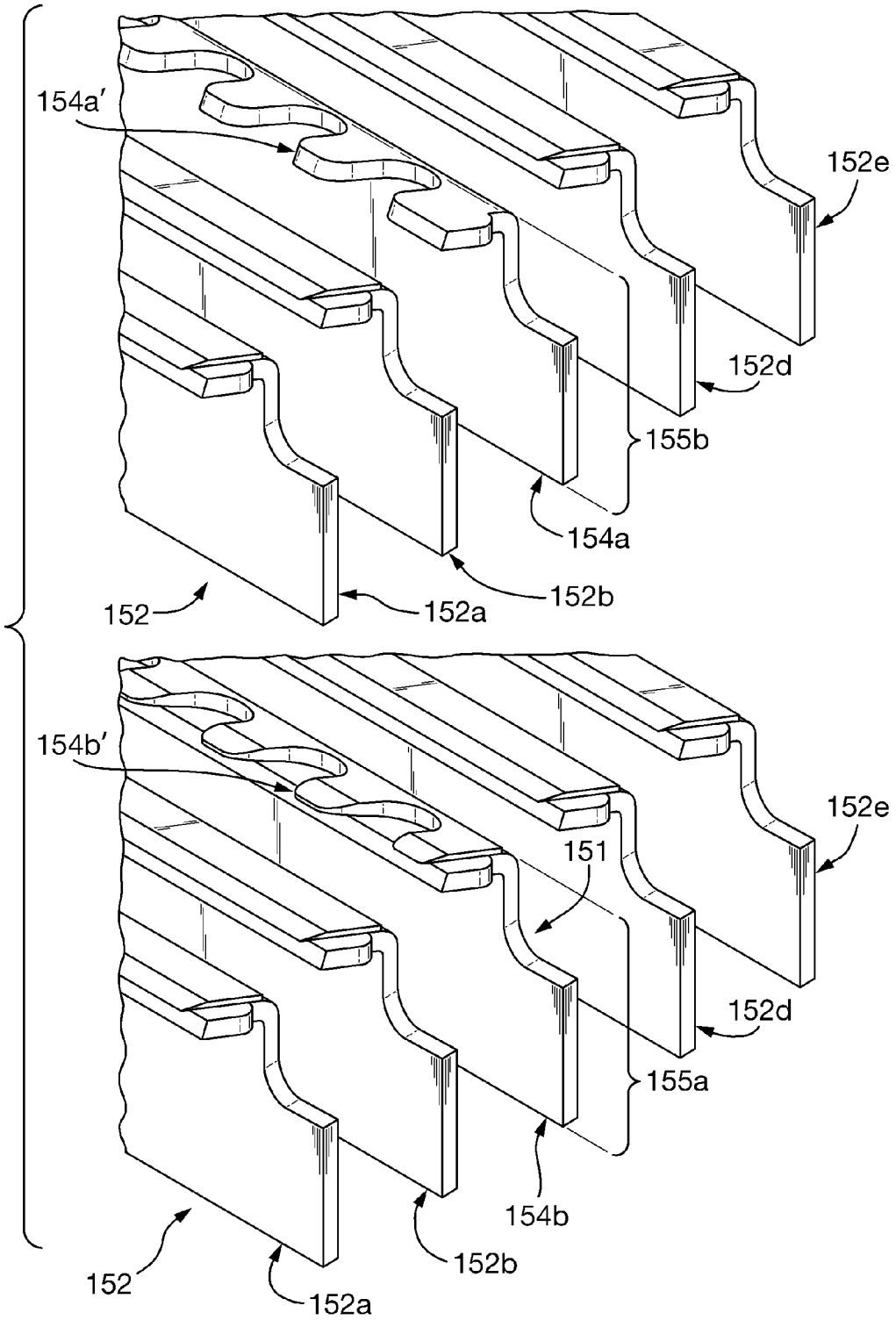
Figure 5M:
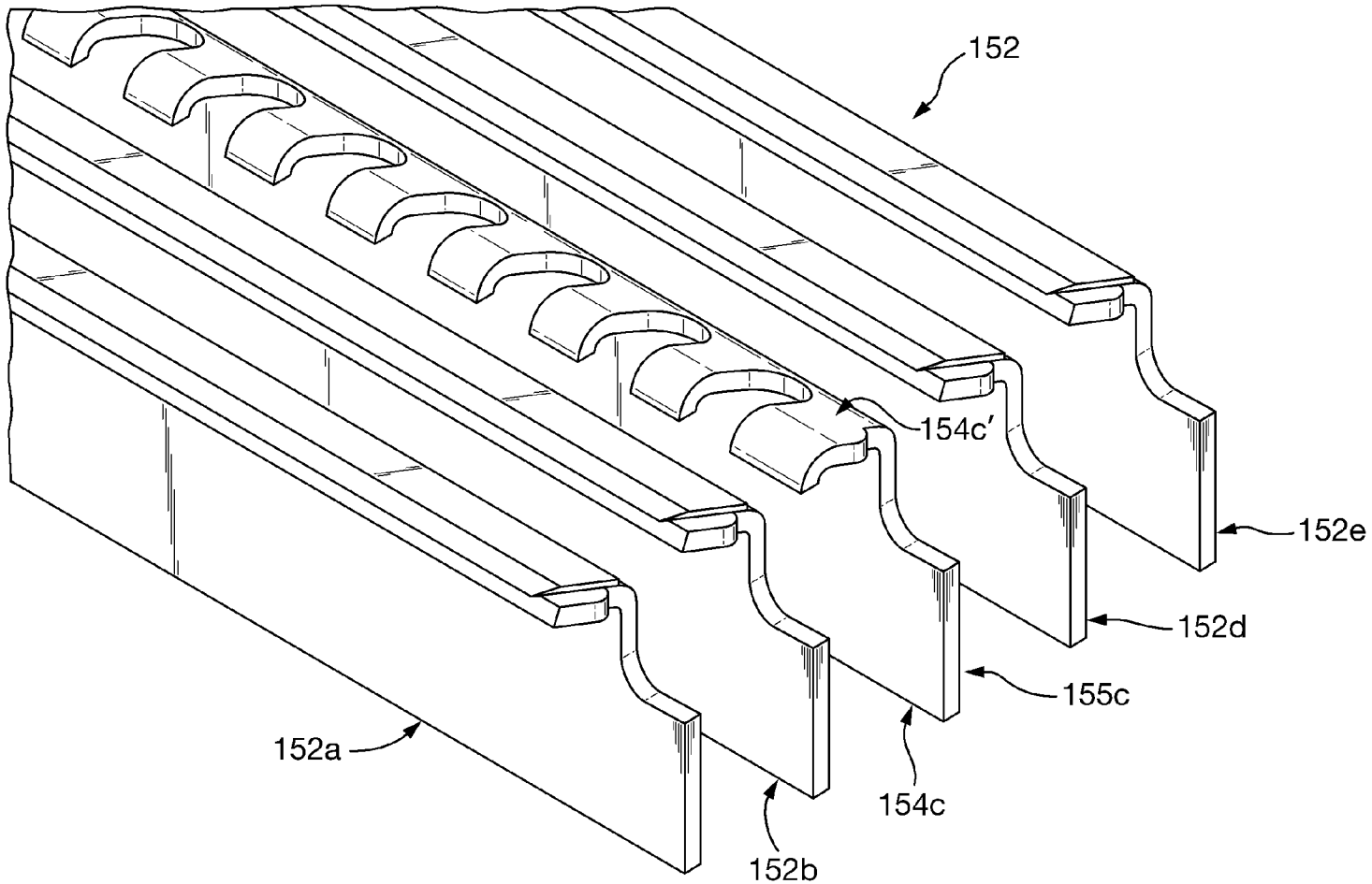
Figure 5N:
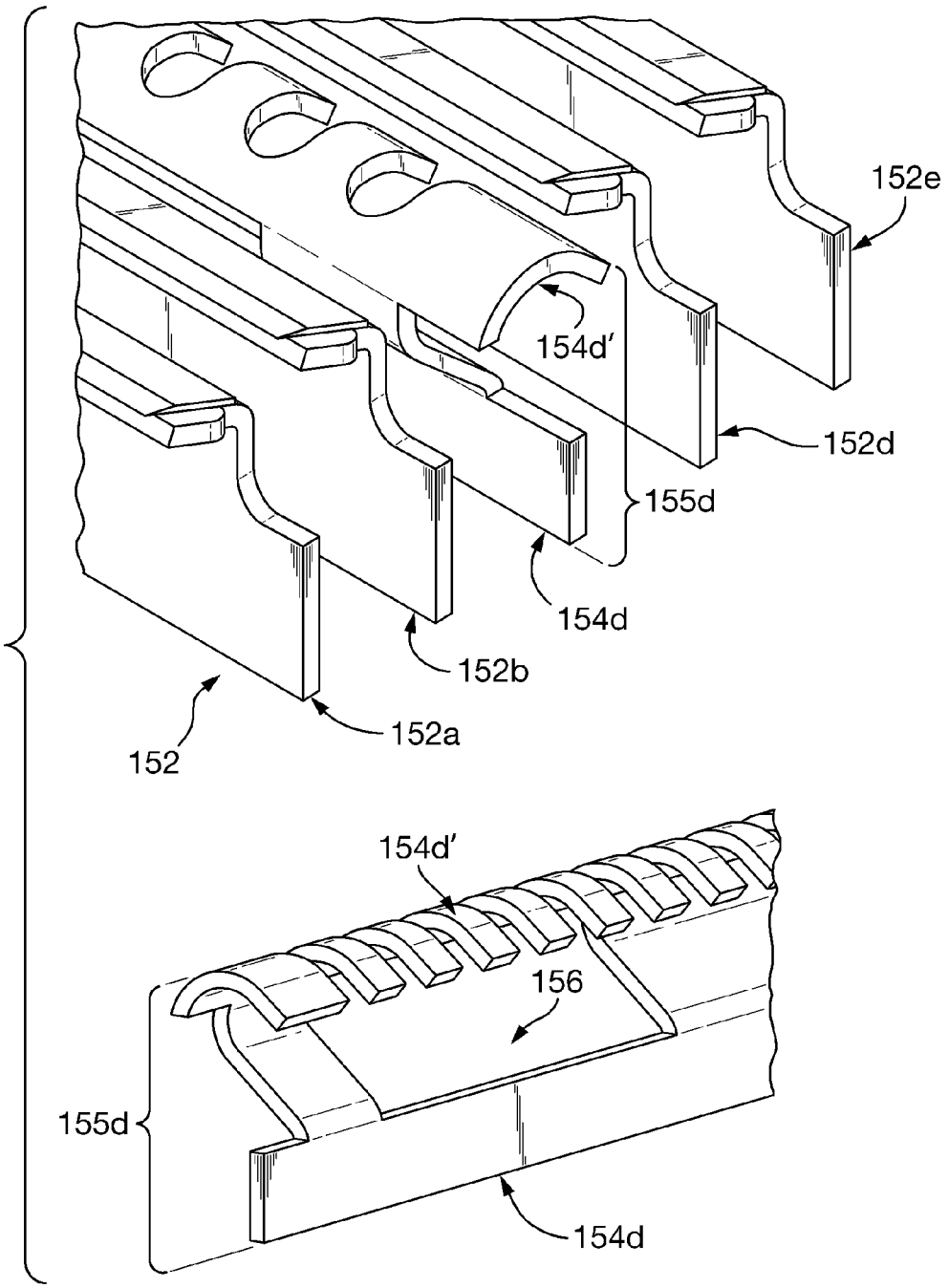
Figure 5O:
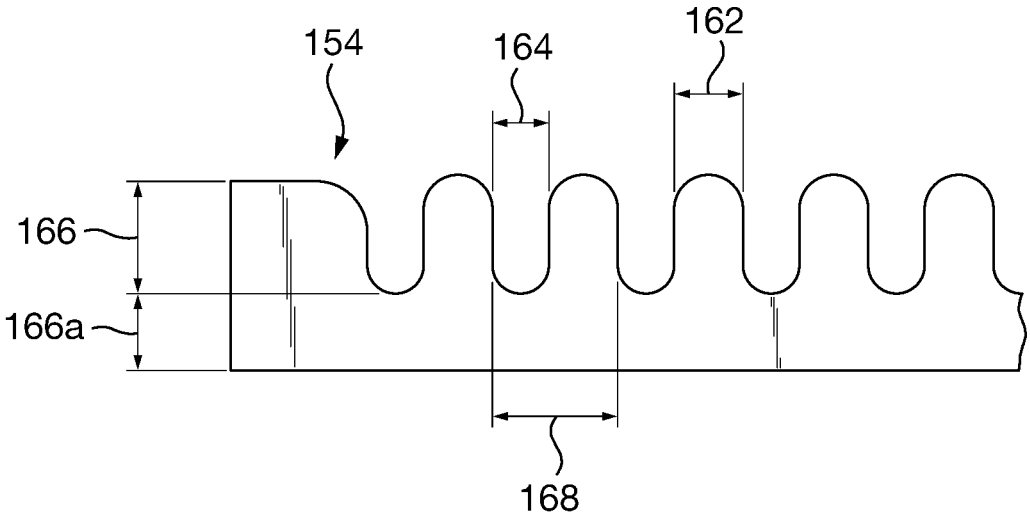
Figure 5P:
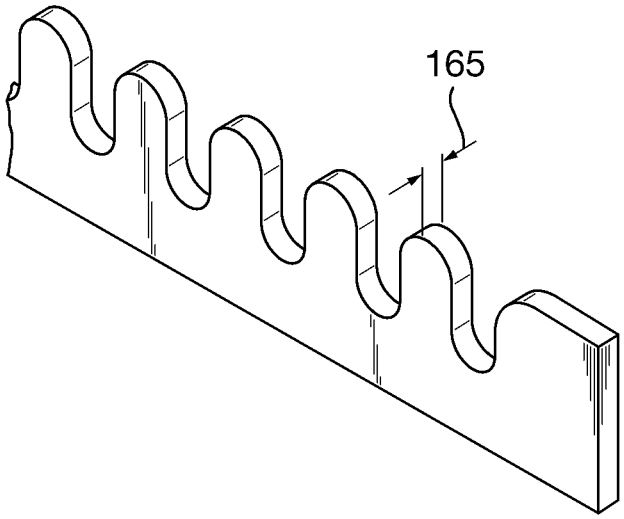
Figure 5Q:
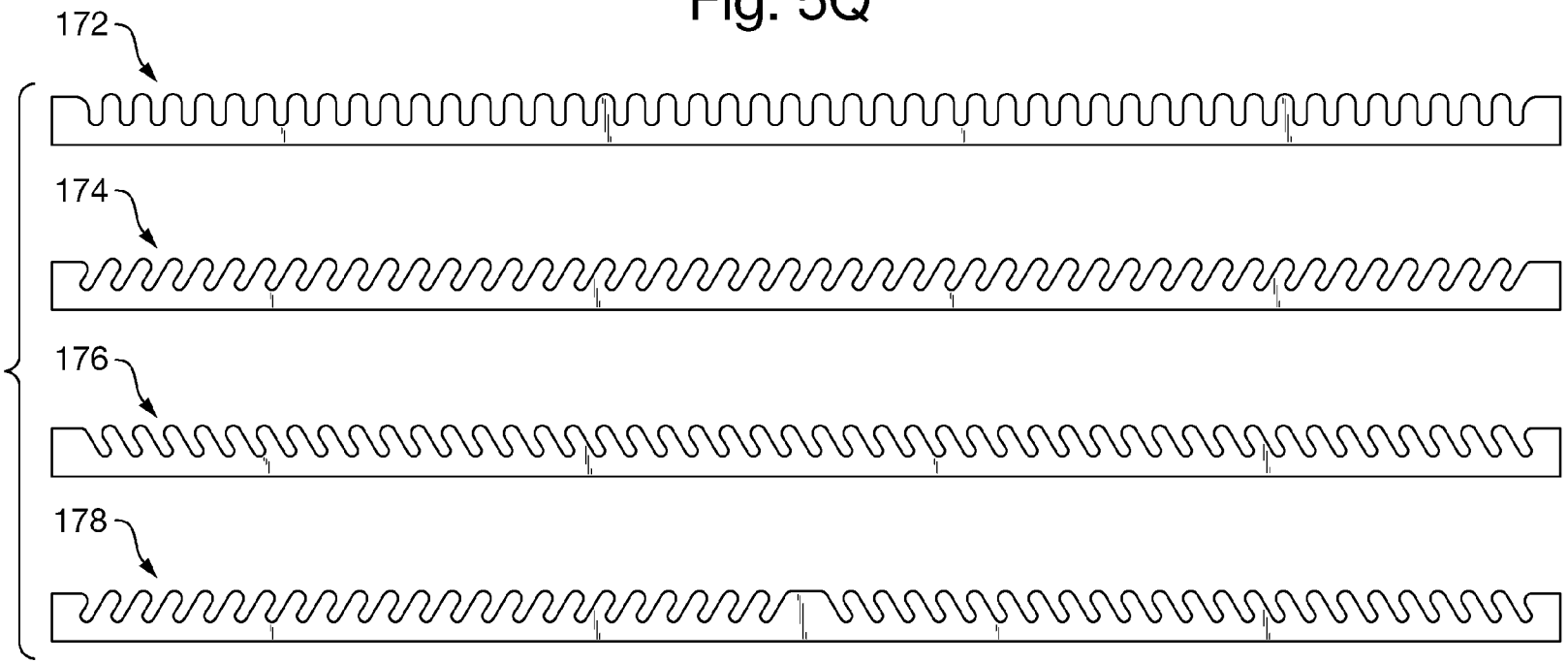

Referring now to FIGS. 5A to 5Q, various designs of skin contact elements 50 within the scope of the present invention are shown. For instance, in FIG. 5A, a skin contact element 50*a* is shown having an upper surface 51 which is substantially planar or flat and a length 51*a*. The length 51*a* of skin contact element may generally be about the same length as that of a conventional blade and may be about 35 mm to 40 mm or desirably about 36 mm. The upper surface 51 of skin contact element 50*a* may be formed or molded to take on any shape. As shown in FIG. 5A, the element 50*a* may have an upper surface 51 that, when viewed traveling in the widthwise direction of the cartridge 12 from the guard toward the cap, is slightly rounded or curved in a front portion 51*d* with a width of desirably up to about 0.2 mm, is substantially flat for a central portion 51*e* with a width of desirably about up to about 0.3 mm and then has a slanted or downward back portion 51*f* with a width of desirably up to about 0.4 mm. The overall width 51*b* of skin contact element 50*a* ranges from about 0.1 mm to about 1.2 mm and desirably is about 0.3 mm to about 0.5 mm. The height 51*c* of skin contact element 50*a* may generally be about 1.5 mm. Another possible shape for skin contact element 50*a* may be a shape similar to the contour or silhouette of a blade (not shown).

The dimensions of the skin contact element 50*a* may generally desirably be within the same ranges as those of a conventional razor blade for ease of placement in a conventional blade array or razor cartridge.

In FIG. 5B, miniature projections, protrusions or nubs 52 are disposed on the upper surface or base 51 of skin contact element 50 as shown. The present invention contemplates any number of nubs 52 which may each desirably be similar in construction.

The nubs 52 may number from about 50 to 150 and desirably about 50, depending on the spacing, across the length of the skin contact element 50 where the skin contact elements of the present invention may generally extend about the same length as the blades. Each nub 52 may have a height measured from a base or surface 51 of skin contact element 50 to the upper surface 52' of the nub 52 of about 0.25 mm to about 1 mm and desirably about 0.50 mm and a width of about 0.15 mm to about 1 mm and desirably about 0.2 mm to about 0.3 mm measured across the front face 52*c* or rear face 52*c'* and a length between about 0.3 mm to about 1.5 mm and desirably about 0.8 mm as measured from a front face of the nub 52*c* to a rear face of the nub 52*c'* or from a leading edge 52*b* to a trailing edge 52*b'*. The nubs or projections 52 may be much like those found in a conventional guard structure or may be formed or arranged differently, as for instance, described in pending US Patent Application, entitled Shaving Razors And Cartridges, having Ser. No. 12/542,141, filed on Aug. 17, 2009, now U.S. Pat. No. 8,209,867, assigned to the Assignee hereof, except that for the instant skin contact element 50*b*, nubs 52 and open slots 52*a* described below would have desirably smaller dimensions.

Referring to the close-up view in FIG. 5B, a detailed perspective view of two adjacent projections 52 is shown. An open slot 52*a* may be defined between the pair of projections 52 disposed next to each other. Since the width of a human hair may be about 0.10 mm, if the width of the open slot 52*a* is less than about 0.10 mm, then the hair may get caught up in the slot 52*a* and prevent other hairs from properly passing through the slot and to the blade behind or after the skin contact element. If the width of the slot 52*a* is too small, it may hamper proper rinsing of the slot 52*a* and the blade(s) adjacent the skin contact element. Shaving aids, hair, dirt and debris may become trapped within the slot 52*a*, and around the adjacent blades, thus decreasing the effectiveness of the blades to cut hair. This may become even more critical for users that shave infrequently since longer hairs may be even more likely to become trapped and difficult to rinse out. Longer hairs themselves may also be more likely themselves to trap additional hairs, shaving aids, dirt and debris.

The pair of adjacent projections 52 as mentioned define the slot 52*a* that is dimensioned to track hairs through with little or no interaction with the hair so the hair is not captured, trapped or pulled by projections 52, which may cause discomfort. The slots 52*a* and projections 52 are spaced to be as small as possible so as to not impede the hair. The slots 52*a* and projections 52 are also dimensioned to reduce skin bulges within the slots 52*a* and pressure points at ends of slots 52*a*, which may result if the projections 52*a* or slots 52 are spaced too far apart. Skin bulges may lead to the blade edges (e.g., in particular blade 12*d*, not shown) unnecessarily cutting the skin, resulting in discomfort. The relatively large number of projections 52 over the length of the skin contact element 50*b* may serve to distribute the force placed on the skin by the cartridge 10 while the increased number of slots 52*a* may also increase the number of hairs passing through the slots 52*a* of the skin contact element, which may increase the number hairs that are properly cut by the blade edge 13*d* of blade 12*d* (not shown) for instance, if arranged as in FIG. 1 for instance of the present invention.

Thus, a chief benefit of nubs 52 disposed on the skin contact element 50*b* may desirably be the setting up or the feeding and alignment of the hair via the slots 52*a* to the blade and/or blades behind the skin contact element 50*b* (e.g., in FIG. 1, blades 12*d* and 12*e*) which may desirably improve efficiency. Additionally, the projections 52 may serve to massage or increase blood flow in a skin area.

The slot 52*a* may have the same width from the leading end portion 52*b* to the trailing end portion 52*b*' or the slot width may be tapered. The slot 52*a*'s leading end portion 52*b* receives hairs and the slot's trailing end portion 52*b*' feeds the hair to the blades in the back of the cartridge (not shown) for cutting. The leading end portion 52*b* may have width $w_1$, of about 0.1 mm to about 0.5 mm and desirably about 0.20 mm. The trailing end portion 52*b*' may have a width $w_2$, that is less than $w_1$, to provide a tapered slot 52*a* for funneling hair to the blade behind the skin contact element. The leading end portion 52*b* of the slot 52*a* may have a chamfer or a lead in (not shown) that tapers from the leading end portion 52*b* to the trailing end portion 52*b*' to provide more efficient handling and passage of the hair.

The pitch or spacing in the open slots 52*a* between a first side surface 52*d* of one of the nubs 52 to a next first side surface 52*d*' of the adjacent projection in FIG. 5B may be from about 0.20 mm to about 1 mm and desirably about 0.2 mm to about 0.4 mm.

Though not shown, the slot 52*a* may extend beyond the front face 52*c* of the adjacent projections 52 resulting in a slightly greater length of the slot than the length of the adjacent projections 52.

The height of the projections 52 may be tapered or stepped up or down such that the height of the projections 52 near the leading end portion 52*b* of the slots 52*a* may be more or less than the height of the projections 52 toward the trailing end portion 52*b*' of the slots 52*a*. A step or angled upward design may increase strength of the skin contact element 50*b* and may improve the tracking of hair into the slot 52*a*. Generally, the arrangement in FIG. 5B placed in a razor cartridge may target both short and long hairs.

The nubs 52, as shown, are disposed such that hair will flow in the slots 52*a* in a transverse direction to the blades (e.g., in the width-wise direction of the cartridge 10, from the guard 16 toward the cap 17). In addition to the transverse arrangement described, in accordance with the present invention, the nubs 52 may, if feasibly desired, also extend parallel to the cutting edges of the blades, at angles, in zigzag, chevron, herringbone or checkerboard patterns, or in any combination thereof.

Referring now to FIG. 5C, skin contact element 50*c* is shown having a repeated pattern of waves 53 or small ripples, surf swells or other similar patterns, disposed on its upper surface 51. The waves 53, as indicated in the close-up view of FIG. 5C, depict a wave having desirably 15 degrees and up to about a 60 degree angle opening as shown at angle 53*a* and a pitch or spacing 53*b* of about 0.30 mm to about 0.80 mm and desirably about 0.50 mm to about 0.60 mm. The wave height or depth 53*c* may range from about 0.20 mm to about 1 mm and desirably be about 0.50 mm. The number of waves 53 may range from about 50 to about 100 waves across the length of the skin contact element 50*c* and may be desirably about 75 waves.

Depending on the angle opening and other dimensions of the waves 53, the arrangement in FIG. 5C placed in a razor cartridge may aptly target short, low lying hairs that may be missed by the conventional guard in the front of the cartridge.

In FIG. 5D, one or more projections 54 are shown on skin contact element 50*d* of the present invention. The projections may be nub or fin-like elements. The projections 54 may desirably be made of metal, plastic, or elastomeric materials. Projections 54 may be arranged in one or more rows or arrays that are parallel, perpendicular, staggered, patterned, angled (or any combination thereof) to the cutting edges of the blades. As shown in FIG. 5D, the projections 54 are arranged in two rows 54*a* and 54*a*' extending along the length of the skin contact element 50*d* and arranged with a plurality of open slots 54*b*' in between the projections for allowing the free passage of hair during shaving.

Each nub-like element 54 may have a width 54*b* of about 0.10 mm to about 1 mm or desirably about 0.4 mm to about 0.5 mm and a height 54*d* of about 0.30 mm to about 1 mm or desirably about 0.5 mm or 0.60 mm. The projections may have open slots 54*c* with a width of about 0.15 mm to about 0.8 mm and desirably 0.20 mm and a pitch or spacing 54*c*' of about 0.25 mm to about 2.0 mm and more desirably about 0.60 mm.

As shown the projections 54 may have slightly rounded tips or curved upper surfaces 54' though any shape for an upper surface 54' is contemplated in the present invention.

In each row of projections 54, there may be about 50 to 80 projections 54 or desirably about 65 to 70 projections 54 disposed along the length 51*a* of the upper surface 51 of the skin contact element 50*d*. As described above in conjunction with nubs 52 in FIG. 5B, the projections 54 may also be arranged (though not shown) with equal dimensions throughout the length 51*a* of the skin contact element 50*d* or with varying dimensions (e.g., tapering or decreasing widths or projection dimensions) or any combination thereof.

By having rounded or curved upper features, the projections 54 in FIG. 5D may provide favorable skin loading and by having two rows of projections 54, the hair may theoretically be better lifted or aligned for the blades behind the skin contact element to cut them.

In FIG. 5E, a combination of fin-like elements 55 and a lubricating strip 56 are shown, each extending across the length of skin contact element 50*e*. This bifurcated arrangement may be beneficial for a multi-stage cartridge, as described above in conjunction with FIG. 4B, for instance where the skin contact element acts as a cap or lubricating strip in the first cartridge unit 10*a* or first stage and acts as a guard in the second cartridge unit 10*b* or second stage. The fin-like elements 55 of skin contact element 50*e* may be of or similar to the type described above in conjunction with FIG. 5D or slightly finer in dimensions and more flexible. The lubricating strip 56 may comprise a material of any known type of lubricating strip and may, for instance, include aloe, vitamin E, minerals or oils. The two portions 55 and 56 of the skin contact element 50*e* may be attached together via any known and desirable method of attachment, such as but not limited to, seals, adhesives or other known mechanical means. If feasible, more than two portions may be attached together forming one skin contact element 50*e* of the present invention.

An area or valley 57 is formed extending across the length 51*a* of skin contact element 50*f* as shown in FIG. 5F and desirably may include a material 57*a* such as any type of composition or shaving aid disposed into valley 57. The composition or shaving aid material may desirably be secreted or exuded when the skin, hair, water or other fluid contacts the skin contact element 50 providing improved skin flow control during shaving.

In FIG. 5G, a combination of nubs 52 and fin-like elements 55 are shown in various portions along the length of skin contact element 50*g*. For instance, nubs 52 of FIG. 5B may be arranged in the central area 50*g*' of element 50*g* as shown in FIG. 5G while fin-like elements 55 similar to those of FIG. 5E are arranged on outer portions 50*g*". This arrangement may provide added comfort or skin protection closer to ends of the blades in outer portions 50*g*" where the fin-like elements are disposed while providing improved hair flow or control closer to the center area 50*g*' of the blades where the nubs are disposed. It should be noted that any such combination of any type of skin contact elements is contemplated in the present invention.

FIG. 5H depicts the skin contact element 50*h* with an exfoliation layer 58 disposed on its upper surface 51. Such an exfoliation layer may desirably comprise fine grade abrasive coatings or surface texture capable of removing at least a portion of a layer of skin, for example, in flakes or scales. Also, the exfoliating layer 58 of the present invention may increase blood flow to a skin area or include ingredients capable of peeling or scaling off small portions of an upper layer of skin (e.g., to remove dead cells).

Figure 1A:
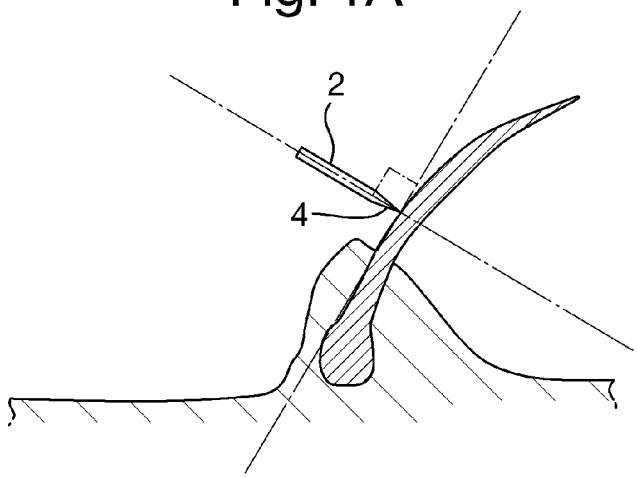
FIGS. 1A and 1B illustrate schematically the interaction between a blade edge and hair when shaving with the grain and against the grain respectively.
Figure 1B:
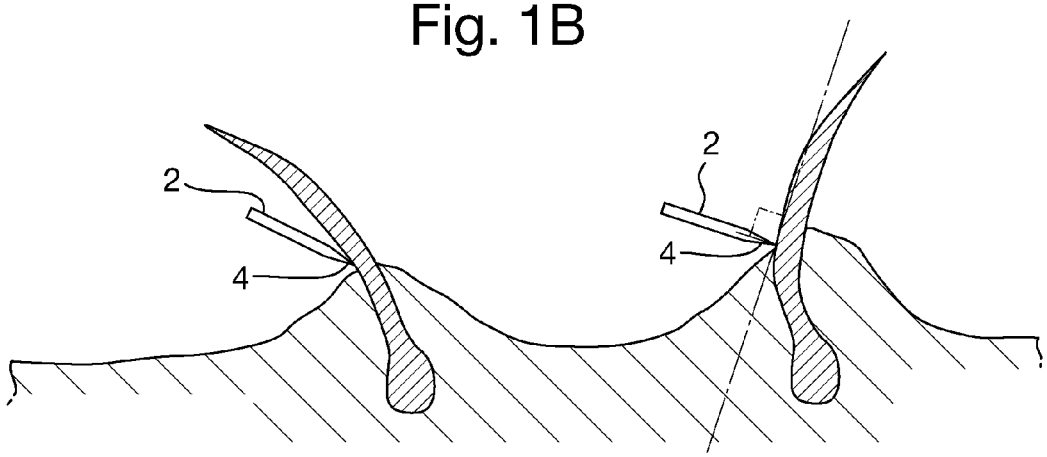

FIG. 5I depicts the skin contact element 50*i* as a sponge or foam 59 which may or may not be embedded with a shaving aid material such as a lubricant. If embedded with a lubricant, the element 50*i* may provide improved glide, increased skin flow and/or other skin improvement or protection while the skin moves smoothly over the skin contact element 50*i*. Such skin control or management may be desirable if skin contact element 50*i* were positioned midway through the cartridge as depicted in FIG. 1 for instance.

FIG. 5J depicts the skin contact element 50*j* desirably formed as a modified or extended blade support made of any material but advantageously comprised of the same type of metal conventionally used for a blade support. Arrows pointing downward in FIG. 5J indicate the top-down loading of the skin contact element 50*j* and blades 12*a*, 12*b*, 12*d*, and 12*e* into the cartridge 12.

In the cross-sectional side view of FIG. 5J shown in FIG. 5K, the skin contact element 50*j* of the present invention may have any shape such as L-shape, a blade silhouette, or have a desirably curved or round leading edge or hook-like structure 59 as shown in FIG. 5K. The curve or hook-like structure 59 provides a smoother surface for the skin to contact as it moves past the skin contact element 50*j*, thereby improving user comfort.

The present invention contemplates any viable structure for the modified blade support type of skin contact element 50*j*. For instance, as shown in FIG. 5J, element 50*j* may be a unitary or single element (e.g., one piece). Thus, one method of manufacturing skin contact element 50*j* may be to modify the blade support and rather than weld a blade with a cutting edge to the top surface of the blade support, extend the blade support profile. The element 50*j* may also be coated with polytetrafluoroethylene (PTFE) or other desirable coatings. Having a similar construction to a standard blade support allows the element 50*j* to be capably handled by conventional razor cartridge equipment without a need or expense for equipment modification.

Another method of manufacturing such a skin contact element (not shown) may be to couple or attach a skin contact element (such as those described above with regard to FIGS. 5A to 5I) to a top area or upper part of a modified blade support either by welding, mounting or otherwise attaching the skin contact element to the blade support portion (e.g., by adhesive or mechanical or thermal means). This may be considered a two-piece modified blade support structure. For instance, the blade support may be extended to include or have disposed on it, one or more fin-like elements or projections onto its top surface, forming an alternative type of modified blade support, or a skin contact element within the scope of the present invention which may be capable of feeding or lifting hairs towards the blades behind the skin contact element. Thus, the skin contact element of the present invention may, if practical, include a one-piece or a two or more piece modified blade support. In either instance, the skin contact element would not be a cutting element.

One-piece and two-piece skin contact elements are shown in FIG. 5L, which in turn depicts an alternate embodiment of the present invention where a skin contact element 154*a* or skin contact element 154*b* may have an upper surface formed as, or augmented with, a kind of comb, or comb-like features having a plurality of teeth which may be desirably rigid but may be flexible or semi-rigid or any combination thereof. The upper surface of skin contact element 154*a* is shown as having a square edge 154*a*' while the upper surface of skin contact element 154*b* is shown as having a tapered edge 154*b*'.

The skin contact element may be a two-piece assembly 155*a* or a one-piece assembly 155*b*. As shown in blade array 152 in FIG. 5L, the two-piece assembly type 155*a* may be desirably located in the middle of the blade array 152 having two blades 152*a*, 152*b* in front and two blades 152*d* and 152*e* in back of the skin contact element 154*b* which is depicted as a two-piece assembly 155*a*. The two-piece assembly of skin contact element 154*b* may be produced in a manner similar to that of a standard blade assembly since the comb skin contact element 154*b* desirably has similar geometry to a standard blade and thus may be joined to a conventional blade support element 151 by laser welding or other techniques known to those of skill in the razor arts.

The one-piece assembly 155*b*, also shown disposed in the center of the blade array 152, includes the square edged upper surface 154*a*' of skin contact element 154*a* contacting a user's skin surface and is formed as a single bent element or as a modified blade support as described above in conjunction with FIGS. 5J-5K.

Both skin contact elements 154*a* and 154*b* may be considered 'drop in' replacements for a standard blade and blade support assembly.

Referring now to FIG. 5M, another alternative embodiment of the present invention is shown where skin contact element 155*c* is depicted as having a single bent element 154*c* similar to the one-piece comb structured skin contact element 155*b* of FIG. 5L except that skin contact element 155*c* desirably may also include a rounded upper surface 154*c*' contacting the skin surface. As above, skin contact element 155*c* may be considered a 'drop in' replacement for a standard blade and blade support assembly as shown in its central location in blade array 152.

FIG. 5N depicts still yet another alternative embodiment of the present invention where skin contact element 155*d* is depicted as a single bent element 154*d* with a rounded upper surface 154*d*' contacting the skin surface. However, the orientation shown is reversed from that of comb embodiments shown in FIGs. L and M. The opening 156 shown in skin contact element 154*d* shown may be sized and shaped to allow the skin contact element 155*d* to ease or slip over cartridge spring fingers or the like, during assembly.

The reverse orientation of the combs in FIG. 5N may desirably contact the skin in a similar fashion as the other combed skin contact elements of FIGs. L and M. By having the skin contact element 155*d* extending backward to the trailing blade 152*d* as shown in FIG. 5N, the skin contact element 155*d* may desirably better lead the hair all the way to the trailing cutting edge than embodiments of FIGs. L-M which depict the comb feature well in front of the trailing blade 152*d* and thus may theoretically not aptly lead the hair all the way to the trailing blade.

This reverse orientation may additionally serve to maximize the radius of contact with the skin and guide the hair to the trailing blade edge. The radius of contact will be described in more detail below. However, just as above, skin contact element 155*d* may be considered a 'drop in' replacement for a standard blade and blade support assembly as shown by its location in blade array 152.

The skin contact elements with combs described above with regard to FIGs. L-N may be, as described in conjunction with other types of skin contact elements, positioned in close proximity (e.g., about 50 μm or greater) to the blade 152*b* preceding, or the blade 152*d* following the skin contact element. In general, the rinse-through gaps for embodiments in FIGs. L-N may be of similar dimensions as those described above with regard to FIG. 2. Similarly, the spans, BTAs and exposure may be similarly modified as mentioned above (e.g., narrow span, increase in BTA, negative exposure of trailing blade), may desirably provide an improved blade tip loading on the skin and improve the numbers of hairs that are cut without skin damage.

In accordance with the present invention, the desirable ranges of dimensions of the structural aspects of the comb or teeth of skin contact elements are shown in greater detail in FIG. 5O. For instance, the width of a tooth 162 of the skin contact elements depicted above in FIGs. L-N, may desirably range from about 100 μm to about 2000 μm and be more desirably about 500 μm and the gap width or open slots defined between teeth 164 may desirably range from about 100 μm to about 2000 μm and be desirably about 500 μm. Generally, the gap width 164 allows the free passage of hair during shaving. The gap depth (or tooth height) 166 may desirably range from about 100 μm to about 2000 μm and be desirably about 650 μm, while the gap pitch 168 which may be generally deduced by adding the dimensions of gap width 164 and tooth width 162 together, may desirably range from about 200 μm to about 4000 μm and be desirably about 1000 μm. The total depth (or total height) which may include the gap depth 166 and a bottom depth section 166*a* of the skin contact element may generally be about the same as a standard blade assembly, typically about 0.09 inches or about 2.29 mm. The length (or thickness) 165 of each tooth, as depicted in FIG. 5P may range from about 75 μm to about 250 μm and more desirably may be about 150 μm.

It should also be noted that in accordance with the present invention, any of these dimensions described herein may be constant or variable along the length of the skin contact element.

Referring now to FIG. 5Q, top views of various "comb" embodiments contemplated, but not limited to, by the present invention. The orientation of the teeth in the skin contact element 172 may be straight or in general, parallel to the direction of the shave. The orientation of the teeth in the skin contact element 174 may be angled right, in the skin contact element 176 may be angled left, and in the skin contact element 178 may be angled towards the center. The differences in orientation may provide benefits to areas of the skin being shaved. For instance, angled orientations may improve shaving (e.g., efficiency) in hard-to-shave areas such as the neck, chin, knees, or underarms.

Advantageously, skin contact elements, arranged or augmented with combs in their upper surface such as those described in FIGS. 5L, 5M, and 5N may, as in embodiments described above (e.g., FIGS. 5B, 5D) also desirably serve to agitate skin to free or release hairs trapped under the skin surface, or other low-lying hairs, align the hairs for the trailing blades, thus preventing hairs from rotating out of the way, and preventing or reducing the skipping of hairs as well as providing rinsing benefits. Such combs or comb-like features (e.g., teeth) on skin contact elements may desirably assist in aligning the hairs and then disengaging the hairs in time for the following proximal blade (or blades) to cut more hairs, both in extent and number. Thus, efficiency is improved as these hard-to-shave areas may be more easily dealt with via combs or other hair-aligning features on a skin contact element. Additionally, by offering the ability to guide hairs directly into the cutting blades, and increasing the hairs cut, the skin contact elements with comb-like features (e.g., teeth) may generally improve the feel of smoothness just after shaving.

Figure 5R:
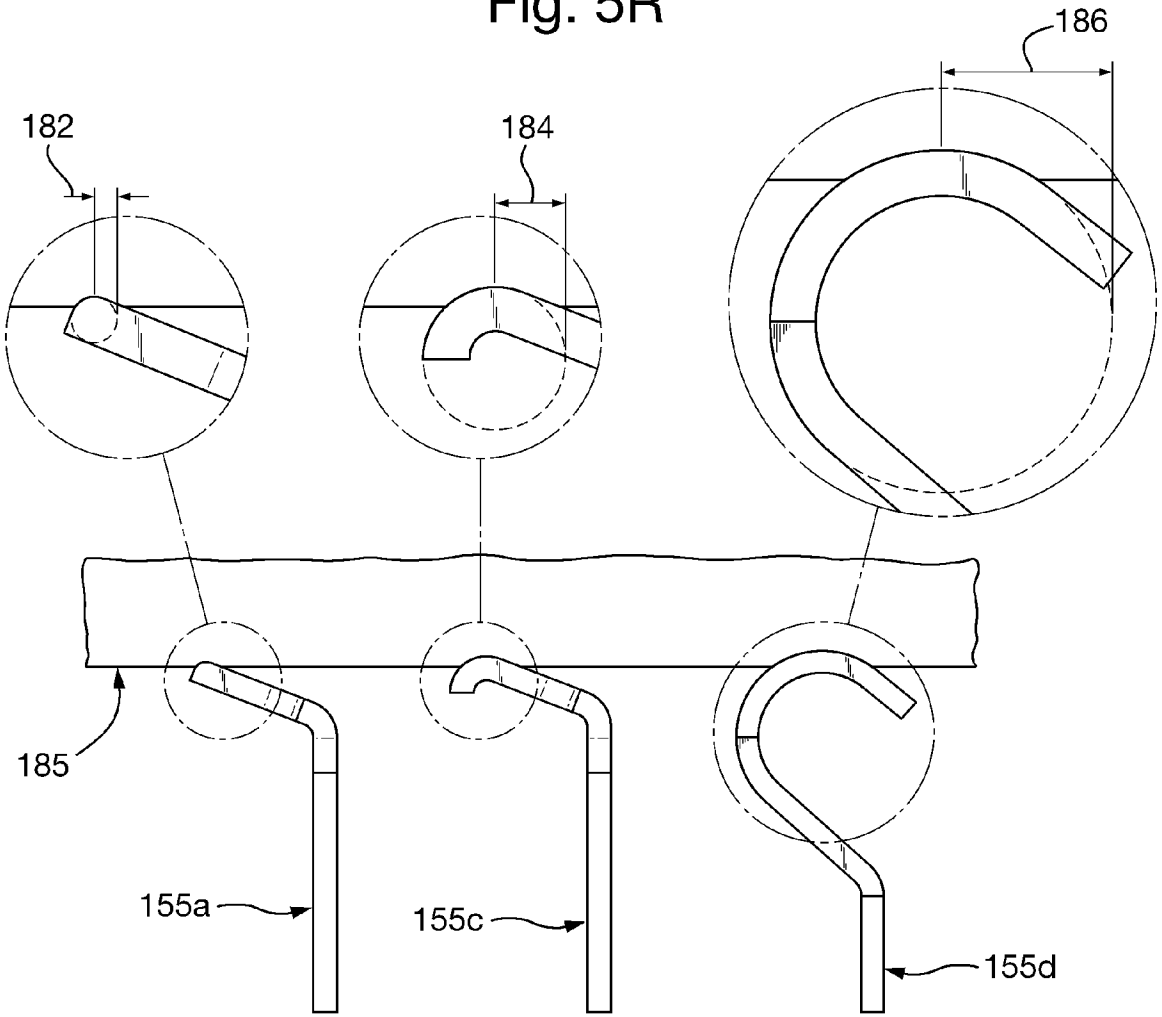

Referring to FIG. 5R, various radii of contact for different skin contact elements of the present invention are shown. The radius of contact 182*a*, 182*b*, and 182*c* is shown for skin contact elements (depicted as similar to skin contact elements 155*a*, 155*c*, and 155*d*, respectively), and represents the radius length of the contact "circle" formed by the upper surface of the skin contact element to a user's skin surface 185. As can be seen, radius of contact 182*a* for skin contact element 155*a* is generally the smallest and desirably less than about 25 μm, while the radius of contact 182*b* for skin contact element 155*c* is a little larger and desirably about 250 μm and the radius of contact 182*c* for skin contact element 155*d* is the largest of the three shown and desirably about 550 μm. Theoretically, all other conditions remaining the same, generally the smaller the radius of contact, the higher the pressure on the skin whereas generally, the larger the radius of contact, the lower the pressure on the skin. Higher pressure may be undesirable as a user may feel it is too scratchy or rough, while less pressure may not rate or feel as nice as some higher pressure alternatives. Thus, a balance may advantageously need to be struck between different types of skin contact elements and their radius of contact to obtain optimal pressure.

While the skin contact elements described thus far are generally loaded into or installed into blade positions or slots from the top of the blade array or cartridge (e.g., similar to razor blade installation), the present invention is not limited to placement of skin contact elements in conventional blade positions or blade slots.

Other methods of manufacturing a skin contact element for placement within a blade array will be disclosed below.

Figure 6:
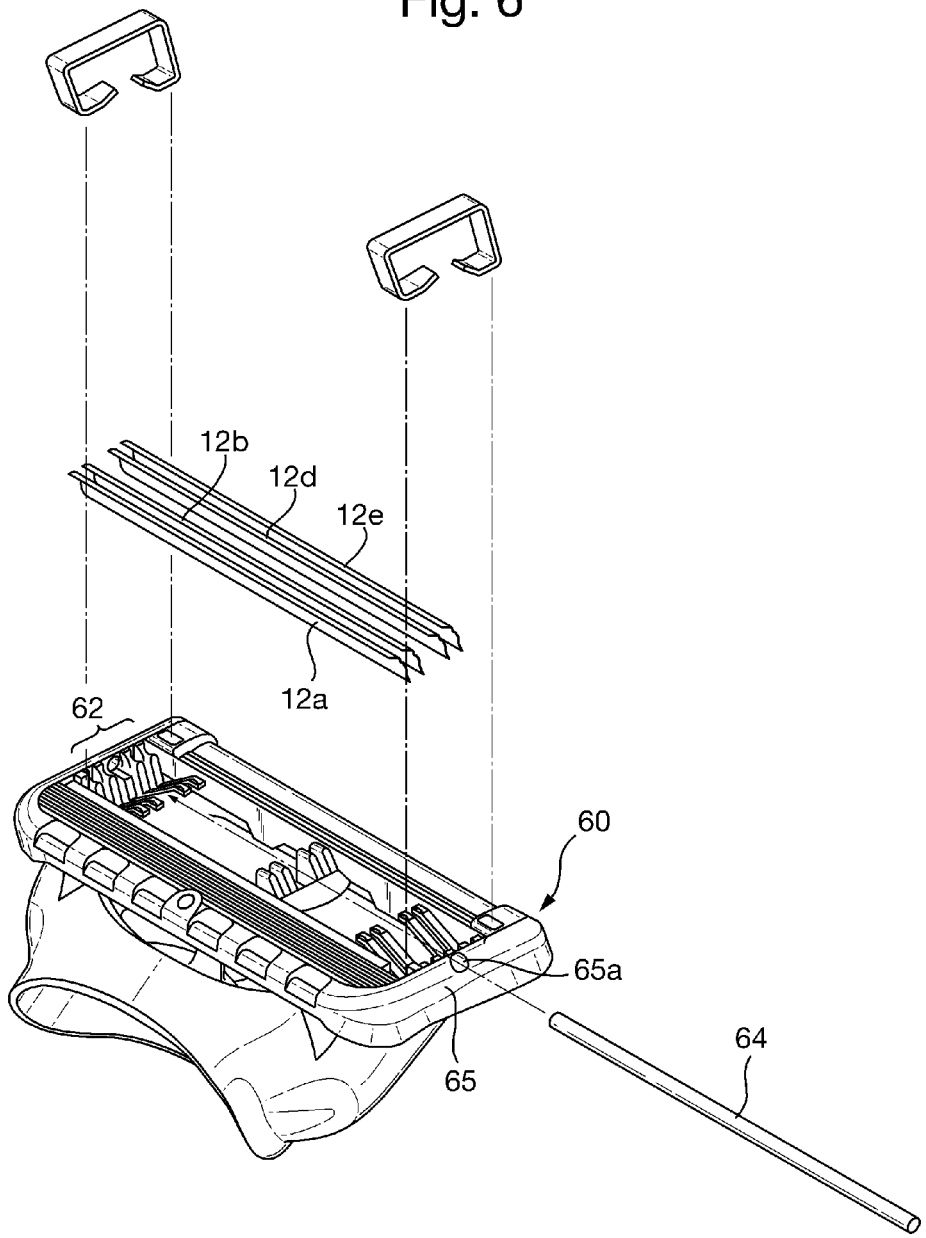
FIG. 6 is a perspective view of an alternate embodiment of a skin contact element in accordance with the present invention.

The skin contact element of the present invention may, for instance, be loaded into the blade array 62 via at least one hole, aperture or slot 65*a* disposed in at least one of the sides of the cartridge frame 65 as shown in FIG. 6 where skin contact element 64 is of a generally round shape but may be of any shape, structure, or composition within the scope of the present invention. Hole 65*a* may desirably be sized and structured to be able to effortlessly insert and generally hold the skin contact element 64 in place within the blade array 62 and therefore, within the razor cartridge 60.

Thus far, the skin contact element of the present invention has been described as being an independent, standalone, or separable element or elements, much like the razor blades themselves. Given that the instant element is a skin contact element with no cutting edges, alternate methods for providing such a skin contact elements in a razor cartridge may also be within the scope of the present invention. Such alternative embodiments of the present invention are described below.

Figure 7:
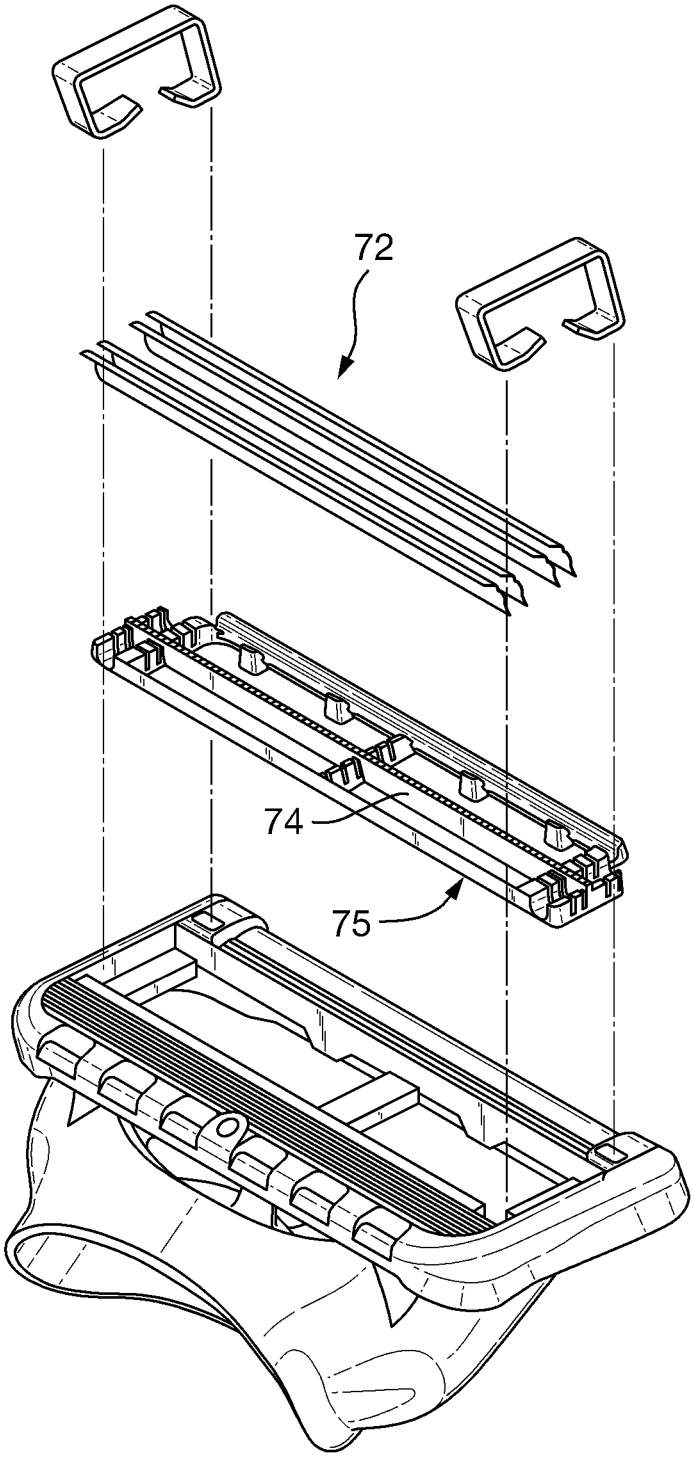
FIG. 7 is a perspective view of yet another alternate embodiment of a skin contact element in accordance with the present invention.

Referring now to FIG. 7, one such exemplary alternate embodiment of the present invention is shown to include at least one skin contact element 74 formed as a portion of the frame 75 as shown in the close-up view of the frame 75 in FIG. 7. For instance, the frame 75 may be injection-molded to include at least one skin contact element 74 desirably positioned lengthwise in any location in the cartridge, as generally described above with regard to FIGS. 1-3. The skin contact element may also be coupled to the frame via a snap fit or other known connection. Skin contact element 74 may be coupled to the frame 75 using other mechanical, thermal, chemical methods known to those of skill in the art. It should be noted that the skin contact element, though formed together with the frame, is not attached to or integrated with a razor blade or blades. The skin contact element, though part of the cartridge frame, may be of any type and may, for instance, include an upper surface of projections, nubs or fin elements (not shown) of elastomeric or other material.

Figure 8:
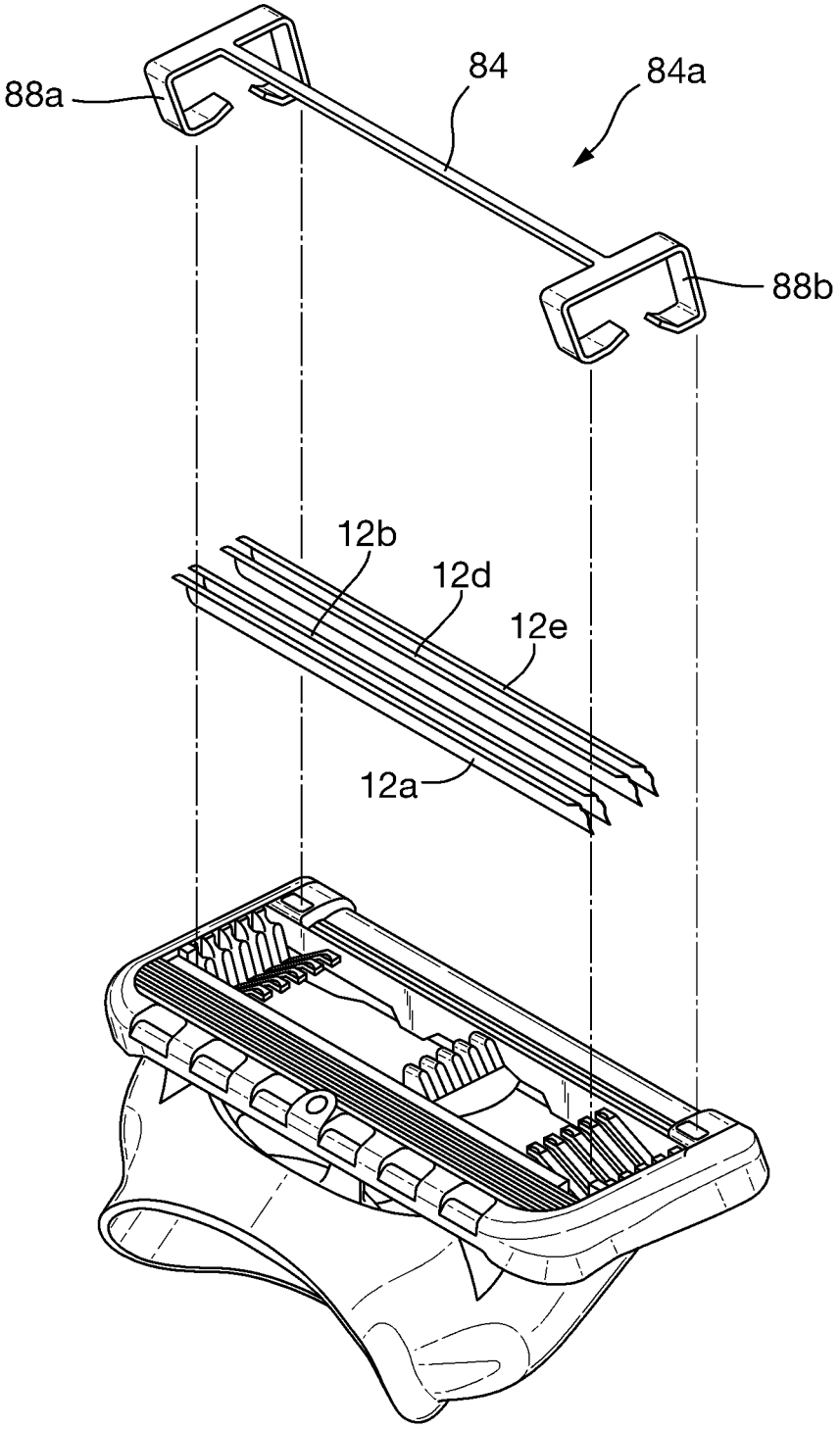
FIG. 8 is a perspective view of still yet another alternate embodiment of a skin contact element in accordance with the present invention.

Additionally, in FIG. 8, another exemplary alternate embodiment depicts a skin contact element 84 formed as a portion of both of the clips 88*a* and 88*b* as a unitary structure 84*a* and therefore necessarily installed into the frame (or cartridge) when the clips are installed. Though not shown, more than one skin contact element may be formed as a portion of the clips or the skin contact element may be formed as a portion of only one or the other clip 88*a* or 88*b*, respectively, in accordance with the present invention. Such a structure 84*a* may be made by one of skill in the art using the same methods as conventional clips and may be machined, molded, or formed in any feasible manner.

Though the skin contact element 74 may be formed as a portion of the frame 75 and skin contact element 84 may be formed as a portion of the clips 88*a*, 88*b*, both being formed as part of another razor component, they are generally not attached to or integrated with any of the blades. The shaving advantages attributed to having at least one skin contact element within the blade array remain unchanged.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge (10) comprising:

a) a housing(16);

b) a guard (40) located at a front (18) of the housing (16);

c) a cap (42) located at a rear (20) of the housing (16);

d) a skin contact element (50) disposed in the housing partway between the guard (40) and the cap (42);

e) a skin contact plane ($P_s$) defined by a plane ($P_{1A}$) tangential to the guard and the skin contact element and a plane ($P_{2A}$) tangential to the skin contact element and the cap;

f) one or more blades (12) located between the guard and the skin contact element, each of said blades having a cutting edge (12') located at a distance (y1) between about 70 μm and 300 μm and an angle (α1) between about 20° and 45° below the skin contact plane;

g) one or more blades (12) located between the skin contact element and the cap, each of said blades having a cutting edge (12') located at an angle (α2) above or below the skin contact plane, wherein (α2) is lower in magnitude than (α1).

2. A razor cartridge as claimed in claim 1, wherein each of said one or more blades between the skin contact element and the cap has a cutting edge located at a distance (y2) between about 50 μm below to 500 μm above the skin contact plane.

3. A razor cartridge as claimed in claim 1, wherein at least one blade between the skin contact element and the cap has a cutting edge located at an angle (α2) between about +/−15° relative to the skin contact plane.

4. A razor cartridge as claimed in claim 1, further comprising a guard to cap plane tangential to the guard and the cap, wherein a top surface (60) of the skin contact element is located between about 50 μm and 500 μm above the guard to cap plane.

5. A razor cartridge as claimed in claim 1, wherein the plane tangential to the guard and the skin contact element intersects the plane tangential to the skin contact element and the cap at an angle (θ) of between about 145° and 180°.

6. A razor cartridge as claimed in claim 1, the one or more blades comprise two or more blades between the guard and the skin contact element, wherein the angle (α1) between successive blade edges and the skin contact plane progressively decreases from the blade adjacent the guard to the blade adjacent the skin contact element.

7. A razor cartridge as claimed in claim 1, the one or more blades comprise two or more blades between the guard and the skin contact element, wherein the angle ($\alpha 1$) between the blade edges and the skin contact plane is greater for the blade adjacent the guard.

8. A razor cartridge as claimed in claim 6, wherein the distance (y1) between successive blade edges and the skin contact plane is substantially the same for each of said two or more blades.

9. A razor cartridge as claimed in claim 7, wherein the distance (y1) between successive blade edges and the skin contact plane is substantially the same for each of said two or more blades.

10. A razor cartridge as claimed in claim 1, the one or more blades comprise two or more blades between the skin contact element and the cap, wherein the angle ($\alpha 2$) between successive blade edges and the skin contact plane progressively increases from the blade adjacent the skin contact element to the blade adjacent the cap.

11. A razor cartridge as claimed in claim 1, wherein the distance (y2) between successive blade edges and the skin contact plane progressively increases from the blade adjacent the skin contact element to the blade adjacent the cap.

* * * * *